US006488283B1

(12) United States Patent
Grundy

(10) Patent No.: US 6,488,283 B1
(45) Date of Patent: Dec. 3, 2002

(54) BOARD GAME

(76) Inventor: Vanessa Ellen Grundy, 2 Brook Street, Hartshorne, SwadlincoteDE11 7AH (GB)

( * ) Notice: Subject to any disclaimer, the term of this patent is extended or adjusted under 35 U.S.C. 154(b) by 0 days.

(21) Appl. No.: 09/676,542

(22) Filed: Sep. 29, 2000

(30) Foreign Application Priority Data

Sep. 29, 1999 (GB) ..... 9922898

(51) Int. Cl.[7] ..... A63F 3/00
(52) U.S. Cl. ..... 273/253; 273/250
(58) Field of Search ..... 273/236, 242, 273/243, 246, 253, 250, 251, 252, 254

(56) References Cited

U.S. PATENT DOCUMENTS

| | | | | |
|---|---|---|---|---|
| 4,395,044 A | | 7/1983 | Hula | 273/253 |
| 4,504,061 A | * | 3/1985 | Michel | |
| 4,575,095 A | * | 3/1986 | Gaster | |
| 4,695,056 A | * | 9/1987 | Cornelson | |
| 4,804,190 A | * | 2/1989 | Hoffman | |
| 4,946,169 A | * | 8/1990 | Hoffmann | |
| 5,037,111 A | * | 8/1991 | Hoffmann | |
| 5,121,928 A | * | 6/1992 | Salerno-Sonnenberg | |

FOREIGN PATENT DOCUMENTS

| | | |
|---|---|---|
| GB | 1275021 | 5/1972 |
| GB | 2076297 | 12/1981 |
| GB | 2139510 | 11/1984 |
| GB | 2210275 | 5/1989 |

* cited by examiner

*Primary Examiner*—Benjamin H. Layno
*Assistant Examiner*—Vishu K Mendiratta
(74) *Attorney, Agent, or Firm*—MacMillan, Sobanski & Todd, LLC

(57) ABSTRACT

A board game comprising: a board having marked thereon a plurality of positions representing features in a real and/or imaginary region of space and with paths between the positions. A number of playing pieces are provided for use by the respective players for movement along the paths in accordance with rules of the game. A randomly operable indicating means, such as dice, determines moves which may be made by the playing pieces. Randomly selectable indicating means, such as cards, are associated with at least some of the positions on the board for determining further factors associated with movement of the playing pieces. means for generating ramdom code and collecting of code by players to win the game.

18 Claims, 22 Drawing Sheets

MBM
IS IT SAFE
WH2
TR CC
GP
WG
SA
SLP
IN
EV
MABH
HO
Su
EM
OE
CH CC
C CC
E CC
I CC
G CC
A CC
B
MA
ZO

WORM HOLE SYMBOL

WORM HOLE ZONE SYMBOL

STAR LOCKED PRISM SYMBOL

BLACK HOLE SYMBOL

ASTEROID BELT SYMBOL

SUN SPOT SYMBOL

SATURN

This is your lucky planet.
you gain a gift from?

(Choose a shuttle)

FACT: This second largest planet orbits the Sun once every twenty nine Earth years.

SATURN

Take Another Card
You leave now but Saturn's icy rings make you land at Titan–Titanions await.
Prepare for Battle.

FACT: Saturn has the most rings & 21 moons, 2 moons are known as "Sheperds" as they keep the rings in place.

PLUTO

This is your lucky planet.
You gain a gift?

FACT: Pluto is the smallest planet in the Solar System

PLUTO

Having reached the furthest planet, you take another card, collect Cosmic Carbon & leave now via Pluto Express FACT: Pluto is smaller than the moon Titan

URANUS

"The Power" have mis–judged the Uranus tilt & you land at a dangerous time.
leave at once.

FACT: There are rings round Uranus & at least 15 moons.

URANUS

This is your lucky planet
You gain a gift from?
dangerous time.
leave at once.

FACT: First planet to be discovered since the use of the telescope.

VENUS

This is your lucky planet
You gain a gift from?

FACT: A Venus day is longer than its year

VENUS

The Electric Dragon* of Venus greets you. Leave now via Z.O.
* Continuos dry lightening FACT: Venusian surface temperatures can reach 1000 F

FIG 12C

MERCURY

This is your lucky planet
You gain a gift from?

FACT: Mercury is the nearest planet to our Sun.

MERCURY

Weird terrain.
Depart now

FACT: Mercury, like Venus, has no moons.

MARS

Marsquake!
Leave now via Z.O.

FACT: Mars has a gigantic volcano. (Olympus Mons) & great red dust storms.

MARS

Take another Card.
Excited Martians greet you with proof of their existance.
Collect 2CC FACT: Known as the Red Planet, Mars has red skys at noon and blue at sunset.

NEPTUNE

Supersonic winds from the great dark spot fly you to Uranus

FACT: Neptune has the fastest planet winds 1200mph at the great dark spot (Gigantic Storm).

NEPTUNE

Neptune's Scooter*
Zooms you straight to Saturn.
*Fastest cloud

FACT: A methane gas atmosphere gives Neptune its deep blue colour.

FIG 12C CONTINUED

FATE

NEARBY NOVA*

All crew need skin grafts.
Miss A Go

* An erupting star.

FATE

ALLIEN ATTACK

Battle or change direction.

FATE

ILLNESS

Scientist in a state of despair.

Travel 6 Dark Years.

FATE

ERRATIC ASTEROID

Travel 4 Dark Years

FACT: The word asteroid means 'like stars'– the name given because they shine.

FATE

PHASE 2

You play a hand in the fate of the Universe. Will it close? Ask 'The Powers That Be'

FACT: Edwin Hubble discovered the Universe is expanding.

FATE

PLANETARY NEBULA*

Effects Matter Transmitter.

Travel 2 Light Years.

*Layers of glowing gas puffed into space from a dying star.

FATE

Unpredictable dark matter forces you into the nearest Black Hole.

(Level 6)

FATE

Anomolies in data reception.
Land now at your nearest planet.

FIG 12d

FATE

STELLAR WIND:

Travel A Dark Year.

FATE

ILLNESS:

Echo from a distant blast causes temporary deafness to crew.

Travel 3 Dark Years.

FATE

REMOTE QUASAR*

Causes data interference

Travel 12 Dark Years.

*The most powerful star like objects in the Universe.

FATE

BOK GLOBULES*

Travel a Parsec.

*Gas and dust being processed to form a star.

FATE

Betelgeuse* may explode.
Travel 5 Parsecs.

*One of the largest stars in the Universe –17000 times brighter than the Sun

FATE

A space tunnel leads you 5 Light Years.

FACT: Light travels through space at 186,000 miles per second.

FIG 12d CONTINUED

FORTUNE

You may ask a favour from the Universe.

FORTUNE

You may ask a favour from the Universe.

FORTUNE

You have entered the constellation of your birth sign. Collect Cosmic Carbon.

FACT: There are more stars in the Universe than grains of sand on every known beach.

FORTUNE

Majestic forces protect your shuttle. Ignore Lunar repairs

Keep this card.
(Continuous use)

FORTUNE

Quasar* Power
(Cancels any instructions)

*Whirling mass of bright hot gas, near Super Massive Black Holes

Keep this card.
(To use twice)

FORTUNE

Crew Member:
C.S.M
(Cloned Service Menial)

ROLE: Serves no purpose.

FORTUNE

Sudden power surge speeds you to your destination.

FORTUNE

Space regulations show you have been miss-treated. All shuttles consult 'The Powers That Be' to see if they pay you Cosmic Carbon.

FIG 12d CONTINUED

FORTUNE

Save a favour
from the universe!

FORTUNE

Cancels a trip
to the Green Planet.

Keep this card.
(May use after battle)

FORTUNE

Get out of Prism FREE!
(Immeadiate escape to Travel The X-miles)

Keep this card.

FORTUNE

You gain E.S.P* to make
you free from illness / virus.
*Essential space protection.

Keep this card.
(Continuous use)

FORTUNE

You find a rock of slate from
a Uranus collision earlier in
history and exchange it
for 3CC.

FORTUNE
SUPER SOLAR WINDS:

Carry you to a planet
of your choice.

FORTUNE
SHARE THE WEALTH

Travel 3 Parsecs and
collect Cosmic Carbon
from all shuttles.

FORTUNE
CLOSE COMET

Collect a crew member
from Crew Bank to help.

FIG 12d CONTINUED

DOOMED
SOLAR WINDS

Carry you to level 3 of the Massive Black Hole.*
(The Event Horizon)

*A gaping void in space that sucks in & devours things that get too close.

DOOMED
DOUBLE DESTINY

Ask the Powers That Be!
If Yes – take another card now + one next turn.
If No – you are doom free

DOOMED
SOLAR WINDS

Carry you to Planet Krod.

"And may the Dork go with you"

DOOMED
WANDERING DEBRIS

Travel a Dark Year.

DOOMED

Aliens Kidnap a crew member, and return them to another shuttle.

(Aliens choice)

DOOMED

A comet has hit you.
Go to a moon for a lunar repairs and take another shuttle to help.

DOOMED

Space matter on your shuttle causes overload.
Eject a crew member or pay Cosmic Carbon.

DOOMED

Crooked aliens hover.
Pay them off with 2CC or battle.

FIG 12e

DOOMED
SOLAR WINDS

Carry you to level 4 of the Mini Black Hole.

FACT: The centre of a Black Hole is called The Singularity.

DOOMED

A Supernova* propels you into the Oscillating Ellipse.

*A colossal stellar explosion.

DOOMED

Aliens take over your shuttle. (Swap all crew with the Alien)

DOOMED

A crew member is accidentally jettisoned into space.

DOOMED

You have broken a space law. Pay Cosmic Carbon.

FIG 12e CONTINUED

SUN
SOLAR FLARE

Sends crew temporarily colour blind.
Land at Mars to recover illness.

*Sudden burst of ultraviolet plasma.

SUN
ILLNESS!

Active zones erupt Helium gas and your laughing crew send you to planet Krod.

"And may the Dork go with you"

SUN
SOLAR WINDS!

Carry you to Titan.
(Moon of Saturn)

SUN
SUN STORM!*

Spins you into the Star Locked Prism.

*Vast clouds of plasma given off by the Sun.

FACT: Sun storms occur every eleven years and help to clear space debris.

SUN
ILLNESS!

Passing through Gamma Rays your crew are bathed in radiation.
Will you loose one?

Ask the 'Powers That Be'

(Aliens choice)

SUN
CORONAL MASS EJECTION*

Solar lumps melt heat sheild.
Go to a moon for Lunar repairs.

*Major eruption of exploding plasma

SUN

You are on a dormant spot.
Well done!

FACT: When Galileo discovered Sun Spots, it proved the sun was spinning.

SUN

It's a rich Sun this year.
Collect Cosmic Carbon.

FACT: Our Sun could hold a million Earth sized planets inside it.

FIG 12f

SUN
SOLAR FLARE

Sends crew temporarily colour blind.
Land at Mars to recover illness.

*Sudden burst of ultraviolet plasma.

SUN
ILLNESS!

Active zones erupt Helium gas and your laughing crew send you to planet Krod.

"And may the Dork go with you"

SUN
SOLAR WINDS!

Carry you to Titan.
(Moon of Saturn)

SUN
SUN STORM!*

Spins you into the Star Locked Prism.

*Vast clouds of plasma given off by the Sun.

FACT: Sun storms occur every eleven years and help to clear space debris.

SUN
ILLNESS!

Passing through Gamma Rays your crew are bathed in radiation.
Will you loose one?

Ask the 'Powers That Be'

(Aliens choice)

SUN
CORONAL MASS EJECTION*

Solar lumps melt heat sheild.
Go to a moon for Lunar repairs.

*Major eruption of exploding plasma

SUN

You are on a dormant spot.
Well done!

FACT: When Galileo discovered Sun Spots, it proved the sun was spinning.

SUN

It's a rich Sun this year.
Collect Cosmic Carbon.

FACT: Our Sun could hold a million Earth sized planets inside it.

FIG 12f

SUN

SOLAR WINDS*

Carry you to Charon.
(Moon of Pluto)

*Constant stream of particles blown throughout Space from the Sun.

SUN

SUN RAPTURE!

You dream of gaining a planet card without travelling to it.
Ask 'The Powers That Be'
(If Yes collect a Planet card from any Planet)

FACT: All planets in our Solar System orbit the Sun.

SUN

It's the years of the Quiet Sun.
You may ignore Sun and Jupiter Spots.

Keep this card.
(Continuous use)

FACT: The Sun is a star.

SUN

Nuclear powered particles soar across Space taking you with them to Travel The X-Miles.

FIG 12f CONTINUED

JUPITER

Oceans of liquid Hydrogen sail you to Europa*
Aliens await – prepare to battle.

*An ice moon with possible underground oceans.

JUPITER

You enter teh Jovian atmostphere at the correct angle.
Travel a Parsec.

FACT: A Parsec = 3.26 Light Years.

JUPITER

Unbeknown chemistries between Zones & Belts catapult you into the X–Miles.

FACT: Jupiter has the greatest storms in the Solar System.
They can last for 300 years.

JUPITER

Spiralling through Jupiters atmostphere you orbit the planet and miss 2 turns.

FACT: Jupiter has at least 16 moons – 4 are the size of planets.

JUPITER

Churning Trojans*
Travel 2 Parsecs.

*Groups of asteroids lying in Jupiters orbit.

JUPITER

The King Gas Giant sucks you in like a cosmic hoover & spits you out to land at Ganymede*

*Jupiters largest moon.

JUPITER

Acid vapour shrinks your shuttle.
Go to a moon for lunar repairs.

FACT: Jupiter shrinks a few millimetres each year; its famous Red Spot is half the size it was 100 years ago.

JUPITER

ILLNESS

Entering the Magnetosphere shock waves affect your crew, who send you to a Sun Spot.

FACT: Jupiter's intense magnetic field spans 7 million miles.

FIG 12g

JUPITER

Passing Comets:
Jupiter world destroys them and hurls you into the Star Locked Prism.

FACT: Jupiter is twice the size af all the other planets put together.

JUPITER

Having dodged radio-active zones, you land at Callisto to rest.

FACT: Jupiter is mostly a gas planet but its hard core centre is bigger than Earth.

JUPITER

Swallowed by a vortex of super heated ammonia, you consult the "Powers That BE" for help.

If yes – they help you to a place of your choice.
If no – you remain to take another card.

JUPITER

Jupiter is in conjunction with Saturn. This help, sends you direct to the planet.

FACT: Jupiter could hold 1000 Earth sized planets inside it.

JUPITER

A confused whirlwind in the Great Red Spot* sweeps you to your destination.

*A hurricane 3 times the size of Earth.

JUPITER

Centrifugal forces, from Jupiters rapid rate of spin, make you land at Lo.

FACT: Moon Lo is completely covered in volcanoes.

FIG 12g CONTINUED

GREEN PLANET
CREW MEMBER
Green Mouse
ROLE: Unlucky. Must be dumped.

GREEN PLANET
Wicked Aliens KEEP a crew member for experimentary use.
(Aliens Choice)

GREEN PLANET
Green suits you.
Travel a Parsec.

GREEN PLANET
Volatile Mountains:
To depart safely you must be slow & throw a "one" to leave next go.
(5 chances per turn)

GREEN PLANET
CREW MEMBER
Mad Scientist
(Display this card)
Eccentric virus sends your Scientists mad.
ROLE: Renders Scientist dormant. Must be dumped.

GREEN PLANET
On landing your controls lock on Z.O.
Leave immediately.

GREEN PLANET
Illness:
Eerie infection takes 2 Crew Members.
(Aliens Choice)

GREEN PLANET
Alien Message:
Do not return to our Planet.
Keep this card.

FIG 12h

GREEN PLANET

Free Pass:
Friendly Aliens will not take you back to their planet.

Keep this card.

GREEN PLANET

Aliens Hold You Back:
You must win a battle to escape.
Begin battle now.

(One battle per turn)

GREEN PLANET

The Planet is quiet.
By leaving now you miss all hazards.
Use Z.O. to score 7 or more.
Failing this you take another card.

FIG 12h CONTINUED

CREW MEMBER

ALIENATOR

ROLE: Destroys Aliens. Ignore battles

CREW MEMBER

BENEFACTOR

ROLE: Owns Star Locked Prism: (Quick route to/from Earth's moon)
Players pay 2CC to escape.
Holder may ignore Prism instructions.

CREW MEMBER

COMETOGRAPHER
(Comet Specialist)

ROLE: Place Comet rings & collect 3CC from players that land within.
Holders may ignore Comet instructions.

CREW MEMBER

FUTURIST
(Black Hole specialist)

ROLE:Escape Black Holes at level 3:
Massive – escapes to the future.
Mini – escapes to Travel The Xmiles.

CREW MEMBER

M.G.
(Member of the Galaxy)
Asteroid Specialist

ROLE: Freely travels up/down belt.
May ignore Asteroid instructions.

CREW MEMBER

DORK

ROLE: Slow down by one each turn.
(Score 1 or 5 to lose me)

CREW MEMBER

DORK

ROLE: Slow down by one each turn.
(Score 1 or 5 to lose me)

FIG 12i

BOARD GAME

CROSS-REFERENCE TO RELATED APPLICATIONS

Priority is claimed to British patent application Ser. No. 9922898.3 filed Sep. 29, 1999.

STATEMENT REGARDING FEDERALLY SPONSORED RESEARCH OR DEVELOPMENT

Not Applicable.

TECHNICAL FIELD

The invention related to a board game.

BACKGROUND OF THE INVENTION

Entertainment or recreational board games in which a player throws dice or spins a wheel or used some other means for generating a random number which represents moves are well known.

BRIEF SUMMARY OF THE INVENTION

The invention is directed to a board game and to a method for playing a novel board game. The playing surface used for the game is a two-dimensional generally rectangular board having a surface which includes positions representing real and/or imaginary regions in space. Paths are provided between various regions in space. Each player has a game piece which preferably represents a space ship or space shuttle. The player pieces are moved along the paths according to a random indicating means, such as dice, or a spinner, or a programmed random indicator.

Details of the board game are set forth in the following detailed description.

DETAILED DESCRIPTION OF THE INVENTION

Figure 1:
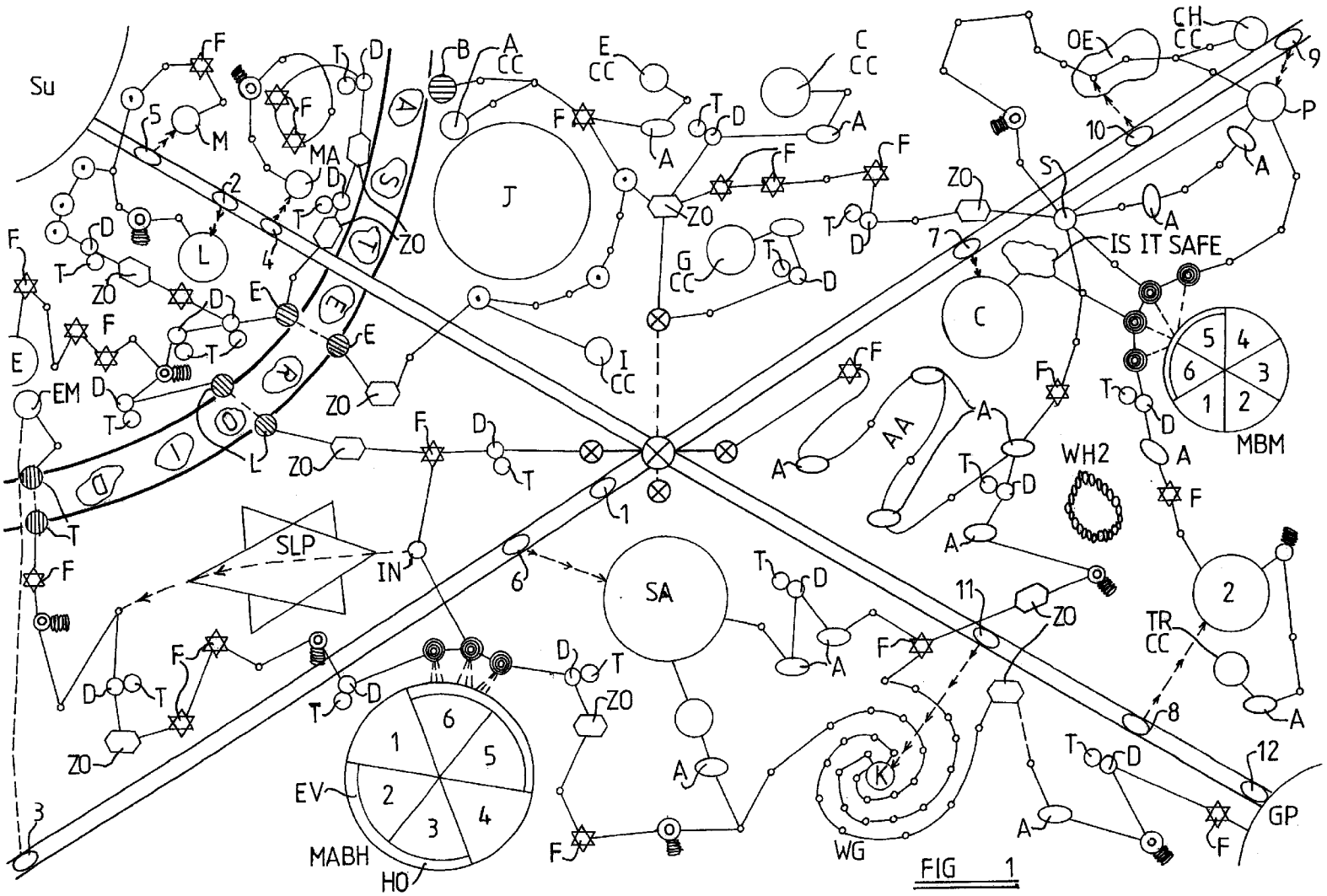
FIG. 1 is a diagram of a playing board according to a first embodiment of the invention.

According to the invention, I provide a board game comprising: a board having marked thereon a plurality of positions representing features in a real and/or imaginary region of space and with paths between said positions; a number of playing pieces for use by respective players of the game for movement along said paths in accordance with rules of the game; randomly operable indicating means for determining moves which may be made by said playing pieces; and randomly selectable indicating means associated with at least some of said positions on the board for determining further factors associated with movement of said playing pieces. The region of space represented by the board may include our solar system, and positions on the board may represent planets in our solar system, moons of one or more of the planets, and one or more planets or other features examples of which are described hereafter and which may be real or fictional.

The game may include randomly operable means for generating a code for each player, elements of which code may be associated with different positions on the board requiring visitation of such positions by each player's playing piece to collect the code. Alternatively or additionally collection of other items and/or information may be provided for, e.g. "valuable elements" as described hereafter.

Each playing piece used by a player may represent a space vessel, e.g. a "space shuttle", and a player may equip or be required to equip his playing piece with appropriate "crew members", the presence or absence of which may negatively or positively influence the manner in which the player is permitted to move the playing piece and/or the outcome when certain situations are encountered, The randomly operable indicating means may comprise or include dice, which may include facets bearing numbers and/or other information, e.g. colors. The randomly selectable indicating means may include cards to be selected by players from a quantity or quantities thereof.

The game may further comprise means representing a currency, which may be used by players in transactions in the course of the game.

It is contemplated that the game may be entitled "Travel The X Miles", and this tide is used in the following description.

The invention will now be described in greater detail by way of example only with reference to FIGS. 1 and 2 of the drawings, which are representations of respective embodiments of boards which may be used in the game. It should be noted, however, that it would be possible to render the game more complex or less complex by the addition of further elements to the board or the omission of elements therefrom, as required. Analogously elements of the playing apparatus may if required be omitted or further elements added, whilst still retaining the nature of the game. Accordingly it is to be understood that the following description of the apparatus and the rules in accordance with which the game is played are given by way of example and not limitation.

On the drawings, each of which represents a region of space including our solar system with certain additional fictional features, the following items are represented by markings on the board, and they appear identified by reference letters as described below:

| Planets | Moons | Others |
|---|---|---|
| E - Earth | EM - Earth's Moon | AA - Alien Alley |
| SU - Sun | A - Amalthea<br>cc | SC - Star Cluster |
| M - Mercury | C - Callisto<br>CC | WG - Whirlpool Galaxy |
| V - Venus | E - Europa<br>cc | MBH - Mid Black Hole |

-continued

| Planets | Moons | Others |
|---|---|---|
| MA - Mars | G - Ganymede CC | MABH - Massive Black Hole |
| J - Jupiter | I - Io | GE - Oscillating Ellipse |

will conclude quite quickly resulting in a shorter game. This alternative ending may produce a different winner to the player leading in Phase 1.

It will be noted the board has lines or tracks marked between various positions on the board, to indicate how playing pieces may be moved as described hereafter. Other markings on the board are referred to in the following description.

The Game in Brief

Travel The X Miles is a futuristic space game requiring skill and memory. Players travel through spars in space shuffles carrying Crew Members who held or hinder their play. The game consists of two phases: If the game remains in phase one, the object is to collect a specific code from the planets and return home to planet earth with the correct Crew Members. If the game is turned into phase two however, the object completely changes. It is then a race back to Earth. Valuable Elements and Cosmic Carbon are also collected, and the winner will be the player holding most, when the first player returns to Earth with the correct Crew Members.

Normal travel is via the stars according to the throw of one dice. When players move forwards, they are said to be travelling in "Light Years" and when they move backwards, they traveling "Dark Years". The quickest route to the planets is by Travelling The X Miles, whereby players move inside the large X which spans the whole of the board from each of the four corners. The X Miles Can be likened to "motorways" in space, and players move according to the throw of two dice. Other quick routes of travel are via Worm Holes, The Asteroid Belt and Zephonic Overdrive.

Players will encounter Aliens, Black Holes, a Star Locked Prism and the Oscillating Ellipse. They may travel in time to the future or past. The venture will include good and bad items being collected, and lucky players may choose to buy Space Miles. The Governing Bodies in space are called "The Powers That Be" who add to a journey of fortune and peril.

Object

Phase 1: The winner is the first player back to Earth holding % the correct code and Crew.

Phase 2: The winner is the player holding the most Valuable Elements and Cosmic Carbon when the first player reaches Earth with the correct code and Crew.

It should be noted that the game is intended to remain in Phase 1 for % the majority, if net all of % the time. If it turns into Phase 2 (upon the turn of a Fate card) it will conclude quite quickly resulting in a shorter game. This alternative ending may produce a different winner to the player leading in Phase 1.

Figure 2:
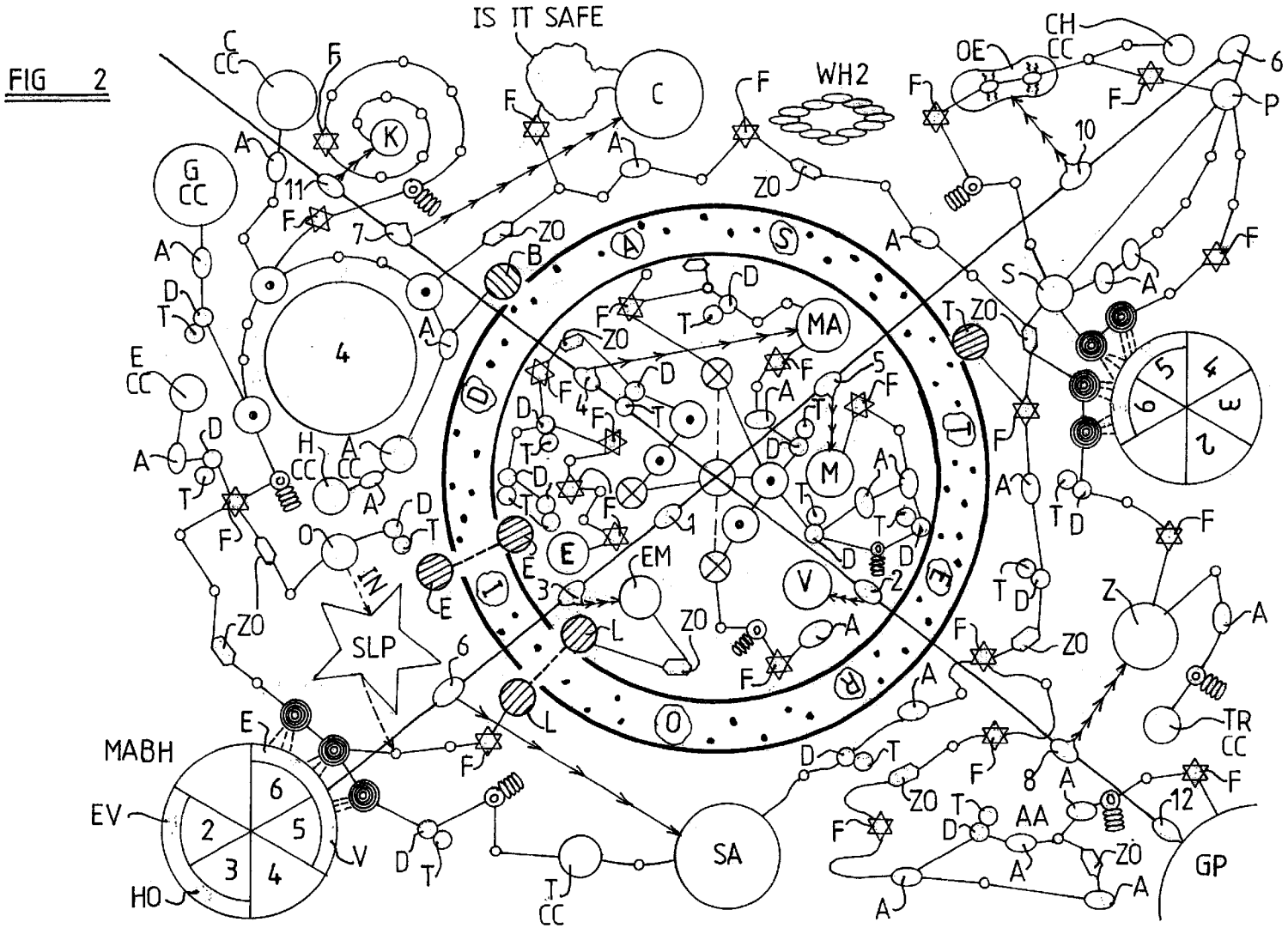
FIG. 2 is a diagram of a playing board according to a second embodiment of the invention.
Figure 3:
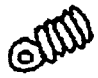
FIG. 3 is a diagram of selected symbols shown in FIGS. 1 and 2.
Figure 3:
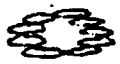
Figure 3:
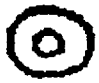
Figure 3:
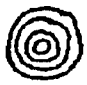
Figure 3:
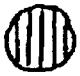
Figure 3:
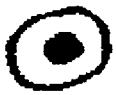
Figure 6:
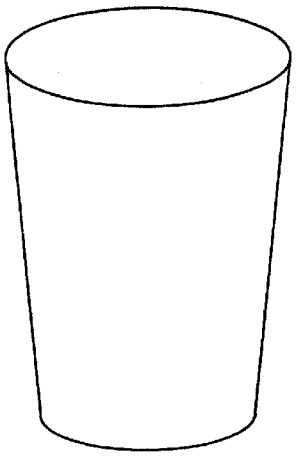
FIG. 6 is an illustration of an exemplary dice shaker.
Figure 5A:
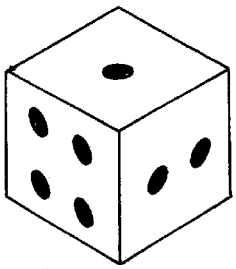
FIG. 5 which consists of FIGS. 5*a*–5*c* is are illustration of an exemplary dice random selection means.
Figure 5C:
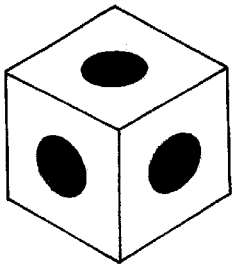
Figure 5B:
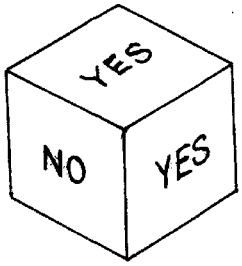
Figure 4:
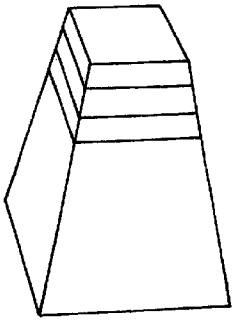
FIG. 4 is an illustration of an exemplary space shuttle.
Figure 9:
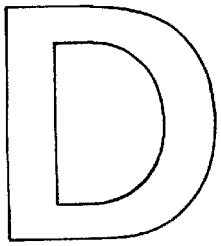
FIG. 9 is an illustration of an exemplary Dork Attachment.
Figure 10:
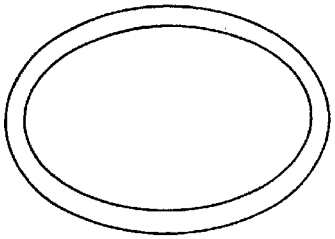
FIG. 10 is an illustration of an exemplary Space Mile Tokens.
Figure 7:
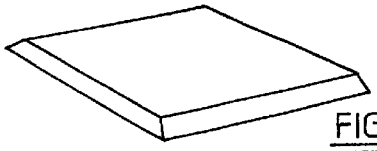
FIG. 7 is an illustration of an exemplary Cosmic Carbon Counter.
Figure 11:
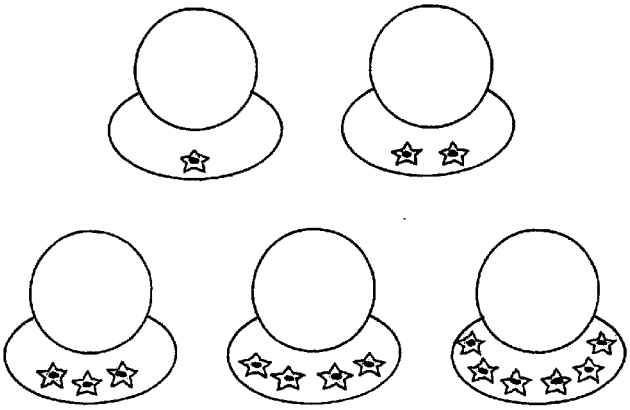
FIG. 11 is an illustration of exemplary Space Mile Tokens.
Figure 8:
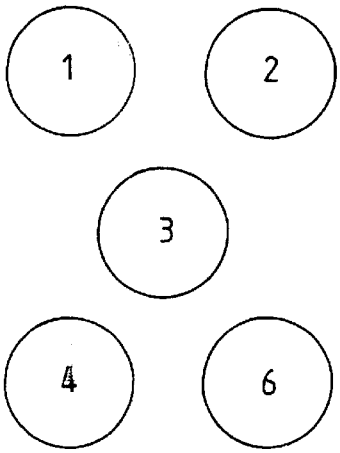
FIG. 8 is an illustration of exemplary Dump tokens.
Figure 12A:
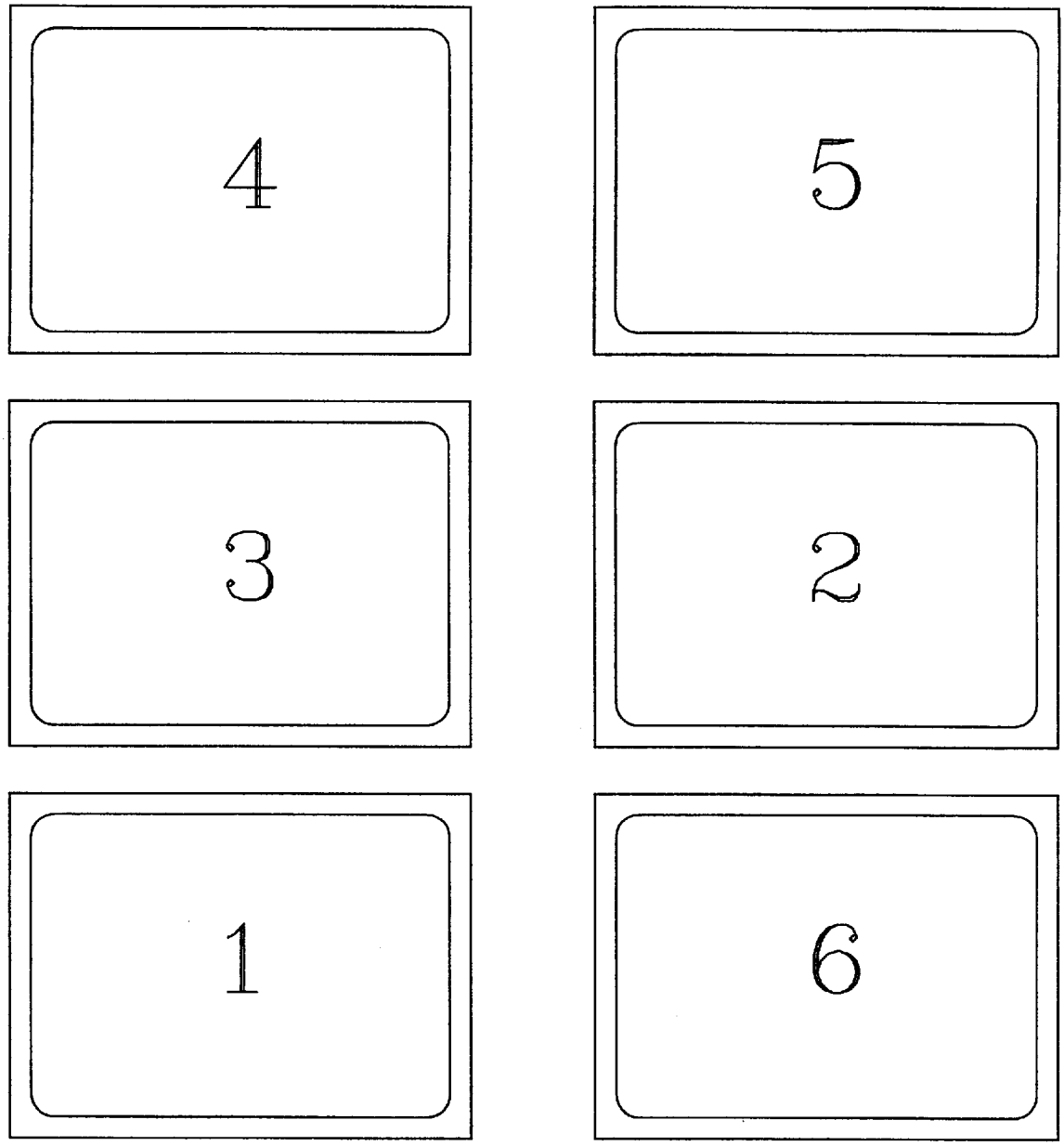
FIG. 12 which consists of FIGS. 12*a*–12*i* are an illustrations of exemplary cards.
Figure 12B:
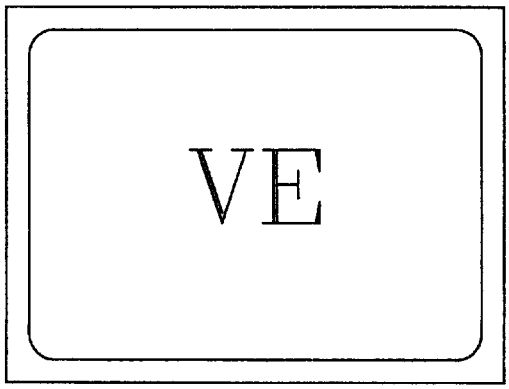
Figure 12I:
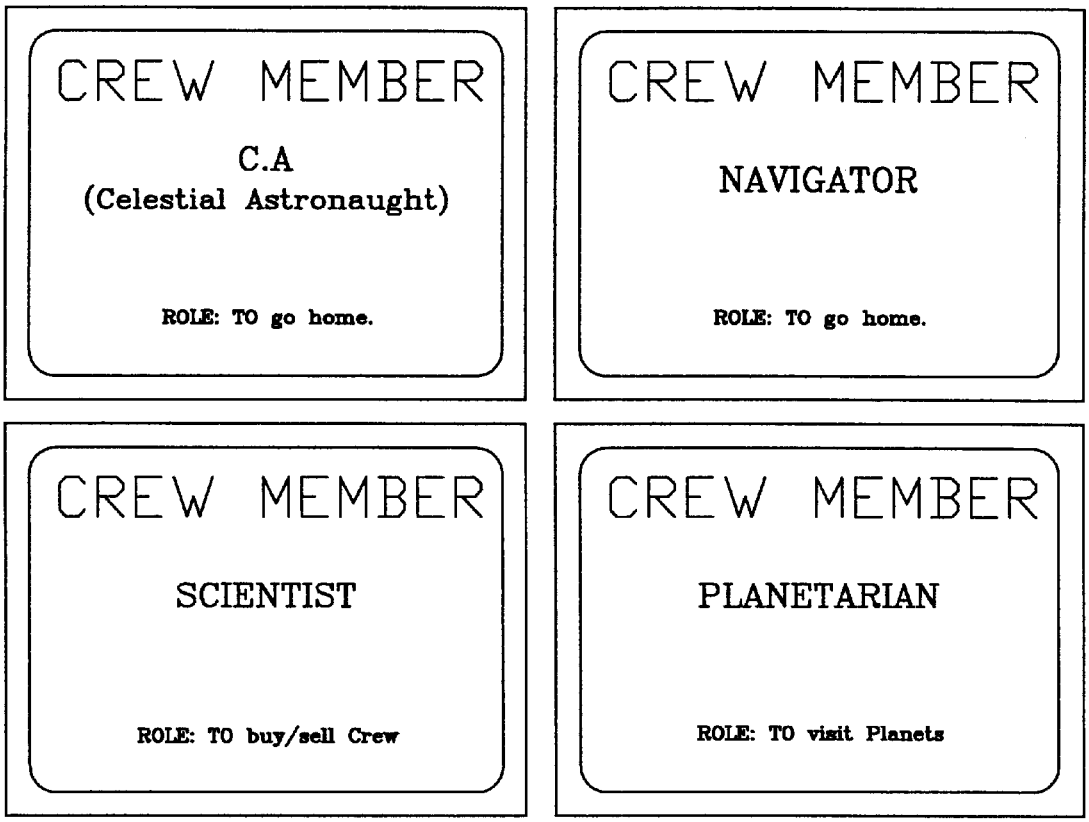

The apparatus for playing the game includes the following:

1 Game Board—FIGS. 1 and 2
7 Space Shuttles (each a different color)—FIG. 4
2 Dice—one illustrated in FIG. 5*a*
1 Yes/No Dice—FIG. 5*b*
1 Color Block Dice (each side a different color)—FIG. 5*c*
1 Dice Shaker—FIG. 6
36 Cosmic Carbon Counters (30 yellow, 6 blue)—FIG. 7
I2 Dump Tokens—FIG. 8
2 Dork Attachments—FIG. 9
3 Comet Rings—FIG. 10
5 Space Mile Tokens—FIG. 11
72 Code (number) Cards (12×1, 12×2, 12×3, 12×4, 12×5, 12×6)—FIG. 12*a*
40 Valuable Element (VE) Cards—FIG. 12*b*
14 Personal Planet Cards (2 of each favorable planet)—FIG. 12*c*
30 Fate/Fortune Cards (15 of each—includes 2 Crew Members)—FIG. 12*d*
30 Destiny Cards (15 Doomed, 15 Teleport)—FIG. 12*e*
11 Sun Cards—FIG. 12*f*
15 Jupiter Cards—FIG. 12*g*
13 Green Planet Cards (includes 3 Crew Members)—FIG. 12*h* 41 Crew Member Cards—includes:—FIG. 12*i*
- 8 Celestial Astronaut (CA)
- 8 Navigator
- 8 Planetarian
- 8 Scientist
- 1 Benefactor
- 1 Cometographer
- 1 Furmist
- 1 Member of the Galaxy (MG)
- 1 Alienator (included in Fortune Cards)
- 1 Cloned Service Menial (CSM) (included in Fortune Cards)
- 2 Green Mouse (included in Green Planet Cards)
- 1 Mad Scientist (included in Green Planet Cards)

Containers for cards/players items.

The numbers indicated above of the different items forming part of the apparatus are given by way of example only and are suitable for playing of the game by, for example, four to six players. It will be appreciated that the game may be played by a lesser number of players, e.g. 2 or 3, or a greater number. Numbers of items may be increased or decreased as desired and, as above referred to, certain elements may be omitted altogether or additional elements added. Features appearing on the drawings may be re-positioned or re-labeled as desired.

PREPARATION FOR PLAY

1. The 6 colored shuttles (not the black one) are placed on the space board according to how many prayers, as follows:
- 2 players: 1 shuttle in Centre of board (X Miles With Options)
  - 1 shuttle in Gateway 1 (X Miles Without Options)
- 3 players: as above+1 shuttle in Earth
- 4 players: as above+1 shuttle in Titan (Moon of Saturn)
- 5 players: as above+1 shuttle in Triton (Moon of Neptune)
- 6 players: as above+1 shuttle in Charon (Moon of Pluto)

2. Each player is given: 1 blue Cosmic Carbon counter
- 2 Dump tokens
- 4 Crew Members (a CA, a Navigator, a Planetarium, a Scientist)

3. The cards: Sun, Jupiter, Green Planet, Fate/Fortune and Destiny are shuffled and placed in their respective card holders.

4. The Crew Members Mad Scientist and Dorks are removed from the Crew pack and placed to one side for use later in the game. If there are 4 or more players, the remaining Crew Members are shuffled and placed in the Crew Bank card holder. If there are less players some Crew cards will need to be discarded, as follows:

2 players: cast out: 4×CA, 4×Navigator
4×Planetarian, 4×Scientist 3 players: cast out: 2×CA, 2×Navigator
2×Planetarian, 2×Scientist This is because players are not allowed to hold more than 2 of the same Crew Member, thus the cards need not be in the game.

To Prepare the Code and Valuable Element Cards

1. Arrange 6 piles of a complete set of the same number card (code), i.e. all the 1's in one pile, all the 2's in one pile, all the 3's in one pile, and so on.

2. Add 4 Valuable Element cards to each of the 6 piles.

3. The remaining Valuable Element cards are placed to form the 7th pile. There should now be 7 piles each containing 16 cards. The 7th pile will contain only Valuable Element cards.

4. Turn each pile over to ensure their contents are not seen.

5. Keeping the 7 piles, re-arrange these piles about one another (shuffle)so that no player knows which pile is which.

6. Add 2 (of the same) Personal Planet cards to each pile, shuffle it and place in its respective planet card holder, as follows: the 2 Mercury Personal Planet cards are added to a pile, which is then shuffled, and placed in the Mercury planet card holder; the 2 Venus Personal Planet cards are added to a pile, which is then shuffled, and placed in the Venus planet card holder; the 2 Mars Personal Planet cards are added to a pile, which is then shuffled, and placed in the Mars planet card holder; and so on. All 7 piles should now be in the 7 planet card containers, and no-one is aware of their contents (other than the Personal Planet cards.) Please note this part of the preparation should be done carefully. The cards should be well shuffled but in a way that no player is able to see any of the cards, as this would obviously spoil the game. The 7th pile of cards which now contains only Valuable Elements and Personal Planet cards is known as the "dummy" pack as it contains no codes. The planet it is placed in (unknown to players) will be referred to as Planet X. (see Planet X)

The Code

The object of the game (Phase 1) is to collect "The Code" from the planets and return home (to Earth). The winner will be the first player home holding the correct Code and Crew Members. The Code is made up of 4 numbers, though players may decide to play with a 3 number Code if a shorter game is required. (See Variations In Play) At the beginning of the game each player throws dice and the first 4 numbers are written down on paper, to be placed on show for all players to see throughout the game. If there are less than 4 players, some players will throw dice again to make up the numbers. This 4 digit number is called THE CODE to be collected.

Players will travel round space visiting the planets to seek out this Code to win the game. They will only be able to collect one number from each planet per visit. Some planet visits will not result in a number being collected. (See Planets and Planet Cards) The Code produced must be a valid Code to play, i.e. Players should ensure that if any one number is repeated, it is done so only once. Examples of Valid Codes are: 2326, 1234, 5112, 3366, and examples of invalid Codes are: 6662, 3433, 5555, 1211. If an invalid Code is produced, players throw dice again to produce a valid one. If players are very lucky they can effectively collect the Code after visiting four planets, and be ready for their journey home. Where this is not the case, travel is continued through space until the Code is found. Once the Code has been collected players must make sure they hold a CA and Navigator Crew Members as they make their journey home.

To Begin

All players shake 1 dice to determine: 1) the Code to be collected; and 2) the starting player.

1. As each player throws the dice the numbers are written down on a piece of paper. Four numbers will need to be recorded—this is then the Code to be collected, and the paper is placed on show for all to see throughout the game. (See The Code)

2. The starting Player will be the first player to throw a "5", and if this has not already been established in writing The Code, players continue to shake the dice, until a player throws a "5". The player who has the first "5" starts the game and uses the shuttle in Gateway 1 of the X Miles (without options) and plays off travelling the X Miles. (see travelling The X Miles.) Play then passes to the left and each subsequent player chooses a shuttle to play with, on their turn. The player choosing the center shuttle will also travel the X Miles (with options) but other players will start in normal play. (See normal play) All players must place their planarian on show for all other players to see. This is proof that they are able to visit the Planets (see Crew Member roles). All other Crew Members add cards are held secret to themselves.

Normal Play

Players travel around the board (space) via the stars connected by straight lines, to the throw of one dice, obeying any star instructions they land upon. (See Stars) Players must always travel forwards (known as travelling light years) unless instructed otherwise, i.e. a card instruction may state that players are to move backwards (known as travelling dark years). To move so many dark years, would mean to travel backwards from where they came. Sometimes players are instructed to move so many "parsecs". Here a parsec=3 light years. Therefore, if a player receives an instruction to travel 2 parsecs, they move forwards 6 stars (or light years). Travelling in parsecs will always be forwards. Players may also change their direction upon receipt of an instruction card stating "Change Direction" (see Card Contents for full details).

Players travel from star to star in the direction of, and connected by, the straight complete lines only. Where they land upon a particular symbol joined to a dotted line, their shuttle will be "drawn" by the dotted line to wherever it leads. (Dotted line movement will be covered in later sections) Once the connecting straight lines lead a player to a planet, the player lands on that planet (placing their shuttle on top of it) and they immediately take a Planet card relative to it. (See Planets and Planet Cards).

Whenever a player throws a "5" (the sign of the X on the dice) they may choose to Travel The X Miles Without Options, if they wish, or they may simply move 5 light years (forwards by 5 stars). (See Travelling The X Miles). This choice on the throw of 5 applies throughout the game when players are all normal play (one dice), regardless of their whereabouts. i.e. It applies in the Black Boles and if players carry a "Dork". (See Black Holes and Planet Krod and Dorks).

Travelling the X Miles

The board is over-lapped by a large X stretching from each of the four comers of space. The X Miles represents the number of miles in distance from our Sun to each of the planets. These miles are marked on the board for players interest, i.e. Mercury is 37.5 million miles and Pluto is 4,500 million miles. These are approximate figures. When players Travel The X Miles, they use two dice and travel inside this large X, which is a quicker and more direct route to the planets, than travel to them in Normal play. thus they can be likened to motorways in space.

The large X is made up of 1–12 Gateways. Number one is an Entrance Gateway, so too is the center of the board (marked X). Gateway numbers 2–12 are all Exit Gateways only. The Entrance Gateways are where players position their shuttle, entering the large X, to Travel The X Miles. The Exit Gateways are where players leave The X Miles via the arrow directional lines which lead them directly to a planet/place. Once players exit The X Miles and are on the connecting planet/place, they are not allowed to re-enter The Miles again at that exit, but must leave the planet/place in Normal Play (via the straight connecting lines) on their next turn.

Players will consider Travelling The X Miles to be advantageous as the majority of exits lead them to favorable planets. However, there is some peril lurking, and on occasions The Miles may take players to places they do not want to go. (See Travelling The X Miles Without Options).

Gateway Numbers And Their Destination:

| | | Distance from the sun: |
|---|---|---|
| X | Entrance (center of board) | |
| 1 | Entrance (without options) | |
| 2 | Exit leading direct to Venus | 70 MM (million miles) |
| 3 | Exit leading direct to Earth's Moon | 93 MM |
| 4 | Exit leading direct to Mars | 140 MM |
| 5 | Exit leading direct to Mercury | 37.5 MM |
| 6 | Exit leading direct to Saturn | 890 MM |
| 7 | Exit leading direct to Uranus | 1800 MM |
| 8 | Exit leading direct to Neptune | 2800 MM |
| 9 | Exit leading direct to Pluto | 4500 MM |
| 10 | Exit leading direct to Oscillating Ellipse | (Jupiter = 483 MM) |
| 11 | Exit leading direct to Krod | |
| 12 | Exit leading direct to Green Planet | |

There are two ways to Travel The X Miles: with and without options:

1) Travelling the X Miles with Options

Players may Travel The X Miles 'With Options' whenever they land on the center of the board (marked X) or any connecting mark of the same, which "draw" their shuttle directly onto the center one, via a dotted line. Players may also gain a card instruction stating "Travel The X Miles With Options" upon receipt of which their shuttle is immediately placed on the center of the board (mark X).

Once on this center mark players immediately throw two dice and move according to their double score. The "With Options" means they can check the score and then decide whether to Travel The X Miles, or not. If players choose not to Travel The X Miles they use that same double score to move off the center mark in Normal play (via straight lines connecting to stars). If players do choose to Travel The X Miles, they move their shuttle directly onto the planet/place indicated by the Gateway exit number of their score. The throw of six places their shuttle directly on Planet Saturn, the throw of eleven places their shuttle directly on Planet Krod, the throw of three places their shuttle directly on Earth's Moon, and so on in accordance with the list: "Gateway numbers and their destination."

If the destination is a planet containing planet cards (see Planets and Planet Cards), the player immediately takes the planet card relating to that planet. All this happens within a players one turn, from when they first move onto the center board Mark X. Players must actually land on a Mark X, rather than just pass over it in movement of dice throw. They may only move onto the Mark X via straight lines, and once on this type of Mark that is adjoined to the center Mark by a dotted line, their shuttle will immediately be "pulled" across the dotted line to the center mark.

2 ) Travelling the X Miles without Options

Players may Travel The X Miles "Without Options" whenever them throw a 5 (the sign of the X) with one dice, in Normal play. Initially they choose whether to Travel The X Miles or to continue to move 5 light years (forwards by 5 stars). If the choice is made to Travel The X Miles, their shuttle is immediately placed in Gateway 1 Entrance, inside the large X. On their next turn, the player throws two dice and must move their shuttle directly onto the planet/place indicated by the Gateway exit number of their score. They do not now have the option they had in the previous section. (Exception: when a player throws double 5 on Gateway 1 they have the choice of moving to the Oscillating Ellipse, or to center space X to Travel The X Miles With Options—see throwing Double Five).

It is important to note that when a player chooses to Travel The X Miles Without Options on the throw of 5, placing their shuttle on Gateway 1, they do not actually travel them (by throw of two dice) until after their next turn, but sit on Gateway 1 waiting. (See Exchanging Space). Whereas players travelling The X Miles With Options (previous section) do so immediately.

Worm Holes

Worm Holes are a faster way to travel space than by normal play, and at times can be more beneficial than Travelling The X Miles. Players enter the Worm Hole Zone from a Worm Hole in one part of space, and exit the Zone via a different Worm Hole, in another part of space. Exemplary symbols are:

Worm Hole symbol: 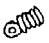

Worm Hole Zone symbol: 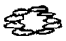

When a player lands on a Worm Hole symbol they must go into the Worm Hole Zone by placing their shuttle in the Worm Hole Zone symbol. They "sit" in the Zone until their next turn (as players do in Gateway 1 of The X Miles). On their next turn, provided they have not already been moved by "exchanging space", they first choose which Worm Hole they wish to exit at. They place their shuttle on that chosen Worm Hole symbol and throw the dice to move off in normal play. The player must choose their exiting Worm Hole before throwing the dice. Players are not allowed to enter and exit the Worm Hole Zone by the same Worm Hole (unless it is out of their control i.e. exchanging space).

Whilst "sitting" in the Worm Hole Zone, players can be deciding which Worm Hole to exit, as other players take their turns. Players always have to go into the Zone when they land on a Worm Hole symbol, they do not get a choice. When they exit the Zone via a different Worm Hole, they travel off that Worm Hole symbol in normal play. They are not allowed to re-enter the Zone, at that time, through the Worm Hole they have just exited.

Exchanging Space

As 2 shuttles are not allowed to occupy The same space at the same time, there may be a lot of "exchanging space".

This adds to the fun of the game! When a player is on Gateway 1 of The X Miles and another player throws a 5 and decides they want to Travel The X Miles, both players exchange space (swap places). The player coming from the Gateway adheres to any relevant instructions, once on the new position, i.e., if the player swaps places with a player that was on a planet, the new player on the planet takes a planet card. If the player swaps places with a player that was on a Fate & Fortune star, the new player on the star takes a Fate & Fortune card. Where this happens players must be careful not to lose the correct rotation of play (who's turn it is).

The player moving onto the Gateway 1 will not Travel The X Miles until their next turn, which again may allow other players to exchange their space. Exchange of space may also occur when a player is in the Worm Hole Zone (see Worm Holes) and another player lands on a Worm hole. The players then have to exchange space (swap places). Players do not get a choice when they land on a Worm Hole, they have to go in it. The player coming from the Worm Hole Zone puts their shuttle on the Worm Hole (formerly held by the exchanging player) and plays off from that new position on their next turn in "Normal" play. The player moving into the Worm Hole Zone will not come out another Worm Hole until their next turn, again allowing for other players to exchange space.

Exchange of space may occur in other situations, i.e., where a player is on a certain level within the Black Hole, and another player receives a card instructing them to go to that same Black Hole at that same level. Both players would swap places. Or if a player is in the Star-Locked Prism when another player has to go in it. However it will not apply in the Oscillating Ellipse as there are two spaces (stars) within it. Exchange of space will also not apply on Planets, Moons and the "Is it Safe" area round Uranus. It will not apply on Stars -where a player is on a star end another player's dice throw would put them on that same star, the second player waits one behind.

Stars

There are 6 different types of stars, connected by straight lines, when travelling in normal play, as follows:

| | |
|---|---|
| O = MAIN SEQUENCE | Nothing happens when players land these. |
| ZO = ZEPHONIC OVERDRIVE | Players landing on these immediately throw 2 dice and move on to their double score (one turn only). |
| A = ALIEN ATTACK | Players landing on these start battle with the Aliens (see Aliens and Battles). |
| F = FATE & FORTUNE | Players landing on these immediately take a Fate/Fortune card and act upon the instructions. |
| DT = DESTINY | Players landing on these immediately take a Destiny card and act upon the instructions. |
| S = SPECTROSCOPE | Players landing on this star, or passing over it, may stop if they wish to travel to Pluto, to use the Spectroscope to see which path to take. (See Spectroscope And Paths To Pluto) |

Variable Stars

The Fate & Fortune and the Destiny stars are both variable stars, named so because their contents vary. A player landing on a Fate/Fortune star will not know whether their card will be a "Fate" or "Fortune" card until they pick it up. Similarly a player landing on a Destiny star will not know whether their card will be "Doomed" or "Teleport" instructions until they pick it up. All card instructions must be obeyed. It may mean that players have to move to other parts of space, i.e., "Teleport To Titan" means the players shuttle is placed on Moon Titan. Some cards will enable players to have more Crew, as the Fortune and Green Planet cards contain actual Crew Members, which players keep. Alternatively, some cards may mean players lose Crew Members, i.e., "Teleport a Crew Member to another shuttle" means the player must give away one Crew Member card to another player. (See Card Contents for full details)

Aliens and Battles

When a player lands on the star identified by a circled "A" (Alien Attack), they must battle with the Aliens (unless they hold a card to say otherwise—see Crew Members). The player seated Opposite plays the Allen's hand and begins the bottle by throwing two dice. The player that landed on the star (defending player) also throws two dice. The player with the highest score wins the battle. (Exception: on throw of double five—see Throwing Double Five). If the defending player is the winner they are allowed to travel off the star using their double score.

If the Alien is the winner the defending player is taken to The Green Planet, i.e., their shuttle is placed on The Green Planet, and that player takes a Green Planet card and follows its instructions. This player will thereby continue play from The Green Planet position (exiting the planet next turn via the straight lines and stars). The player who plays the Alien's hand will have no other involvement. They will be throwing dice only on behalf of the Alien and not as themselves, as a player.

If there is not a player actually sealed opposite to play the part of the Alien, say in a game of 3 players, other players my shake the dice to determine who plays the Aliens part. Once chosen that player will remain that defending players Allen throughout the game. Where battles end in a draw, the battle is fought again.

Cosmic Carbon

Cosmic Carbon (CC) is the Space Currency. The yellow CC counters are one Cosmic Carbon and the blue CC counters are worth five Cosmic Carbon (or five yellow ones). Whenever a player is to receive Cosmic Carbon, it means one counter of it (yellow). Otherwise an instruction will read 2 CC meaning two yellow counters, or 3 CC meaning three yellow counters, and so on.

Each player starts the game with a blue CC counter (worth five yellow ones). When players first exchange it, to pay for new Crew Members or to pay other players, they receive their change in yellow counters. Players can collect more Cosmic Carbon by passing through Moons, one CC counter for each visit, except at Earth's Moon which holds other functions. (See Moons). Cosmic Carbon may be used to buy more Crew Members, one CC per member. (See Buying Crew) The value of Cosmic Carbon is the same as one Valuable Element card (in Phase one of the game) and either may be used to buy Crew Members.

No Cosmic Carbon Left a player has no Cosmic Carbon and needs to pay some to another player, they may pay them a Valuable Element card. If they hold no Valuable Elements, they musk pay them with a Code card, but the player receiving it will choose which one—Blind. (See Blind) If the player is unable to pay with any of these, they are out of the game. Where a player has no Cosmic Carbon and needs to pay the "The Powers That Be" (see Powers That Be) say if they break a Space law, they. art immediately our of the game. No other form of payment is accepted.

Players holding Cosmic Carbon will always remain in the game. Therefore it is in their own interest to watch their stock, and if it gets too low or runs out, endeavor to travel through Moons as soon as possible to collect more.

Also, if the game turns into Phase 2 (see Phase 2), the winner will be the player with the most Cosmic Carbon/Valuable Elements.

Valuable Elements

Valuable Elements (VE's) are cards collected frown the favorable planets. (See Planets). They have the same value as Cosmic Carbon (one VE=one CC) in Phase one of the game, and either may be used to buy Crew Members. However, if the game turns into Phase 2, VE's will be more valuable than CC and may ultimately determine the winner. (See Phase 2).

Blind

Whenever the term 'Blind' is used, it means a player must hold up all their cards (being either Crew Members or Codes/VE cards) facing towards themselves, like a fan of playing cards, for another player to choose and take out the cards they will lose. When a player receives a card instruction stating "Teleport a Crew Member in from all other shuttles (BLIND)", it means the other players hold up all their Crew Member cards (including Planetarian, any Green Mice, Dorks, and Mad Scientist) facing towards themselves like a fan of playing cards, and the first player chooses and takes one from each player's fan. Sometimes when a card instruction states loss of Crew Members, it will be the "Aliens Choice" (see next section). If the choosing player is the Alien (player taking the Alien's hand) they are not allowed to look at the cards being lost. Crew Members lost in this way are placed in the Crew Bank.

Aliens Choice

When a player is going to lose Crew Members and the card states "Aliens Choice" the player seated opposite plays the part of the Alien (just the same as in battles with aliens). The "Alien" must choose the cards to be lost from the player who holds up all their Crew Members towards themselves like a fan of playing cards. The "Alien" selects and takes out the number of Members to be lost, but must not look at them, placing them straight in the Crew Bank. This selecting player is not allowed to lock at the cards because they are acting only on behalf of the Alien and not as themselves as a player. Indeed no other players should know the contents of Crew cards lost this way, only the player losing them. Once players have lost Crew Members, they will need to place their Planetarian back on show, proving that they are still able to visit planets. Obviously if they are unable to do this, having lost their Planetarian, they must buy another one before planet visitation. (See buying Crew).

The Powers That Be

The Powers That Be are the Governing Bodies in space, and players will have to consult them for answers. This is done by use of the YES/NO dice. Some card instructions contain a decision to be made one way or another which determines the action a player needs to take. The decision is left to The Powers That Be, and players use the YES/NO dice on these occasions to find the answer.

The following are examples from the Sun cards:

A player may receive the card instruction: "SUN RAPTURE. YOU DREAM OF OBTAINING A PLANET CARD WITHOUT TRAVELLING TO IT. ASK THE POWERS THAT BE TO GRANT YOUR DREAM. IF YES=HELP YOURSELF TO A PLANET CARD FROM ANY PLANET." The player then throws the YES/NO dice to determine the answer. If YES, they help themselves to any Planet card, as the instruction states. If NO, nothing happens and the next player takes their turn.

Likewise a player may receive the card instruction: "PASSING THROUGH GAMMA RAYS YOUR CREW ARE BATHED IN LETHAL DOSES OF RADIATION. WILL YOU LOSE ONE? ASK THE POWERS THAT BE. (ALIENS CHOICE)." The player then throws the YES/NO dice to determine the answer. If YES they hold up all their Crew Members, like a fan of playing cards (facing towards themselves), for the Allen (player seated opposite) to choose the Member to be lost. If NO the player will not lose one. For further details of Powers That Be instructions see Card Contents. The Powers That Bee decision is final and players must act on their answer.

The Planets

When players land on a planet, they stop and take a planet card, i.e., they place their shuttle on top of the planet and take the planet card relative to it. If they land on Mars, they take a Mars card, if they land on the Green Planet, they take a Green Planet card, and so on. Players leave the planet in normal play on their next turn, except when cards state to leave immediately. Only one card is allowed per planet visit, unless the card states "Take Another Card" upon which players take a second card from that same planet. Players may on occasions need to take a second card when they receive the Lucky Planet Card. (See Planet Cards).

There are seven favorable planets to visit to collect planet cards, in search of The Code. These planets are Mercury, Venus, Mars, Saturn, Uranus, Neptune and Pluto. The Sun, Jupiter and The Green Planet also hold planet cards, but no Codes (number cards), only card instructions which players must obey. Players do not land on the Sun or Jupiter, but travel round them, taking their planet cards when they land on a Sun or Jupiter Spot (See Sun/Jupiter sections). Players must visit another planet before returning to one just visited, unless the second visit is out of their control, i.e., Travelling The X Miles Without Options, instruction card, exchange of space.

Planet Cards

The favorable planet cards consist of Code (number) cards to collect, Valuable Element (VE) cards to collect, and Personal Planet cards to read out. Players will keep the code and VE cards but will only read aloud the content of the Personal Planet cards, obeying their instructions, and returning the used cards to the bottom of their planet pack. Players must adhere to the holding limits as they collect the code cards. (See Holding Limits).

Personal Planet Cards

There are Personal Planet cards in each of the favorable planets, headed by that planet's name. Some Personal Planet cards contain the following instruction: "THIS IS YOUR LUCKY PLANET! YOU GAIN A GIFT FROM? (CHOOSE SHUTTLE)". On receipt of this card the player chooses another player from whom they wish to receive a gift. The gift will be one of that players favorable planet cards (i.e. Code or VE) which they have collected from the planets on their travels. However the gift may not come from the first player chosen, as each chosen player has a chance to defend their rights. Therefore the nominated player consults "The Powers That Be" to cheek if they do have to pay the gift. If the answer is "YES" they hold up all their favorable planet cards for selection by the first player (Blind). (Note these favorable planet cards are CODES/VE'S only, which are smaller in size to all other cards in the game). If the answer is "NO", the nominated player will not pay the gift, and the player with the Lucky Planet card chooses a different player from whom they wish to receive a gift. This different player has the same rights and consults "The Powers That Be". This choosing of players and consulting "The Powers" continues until either a gift has been paid, or all other players have defended their rights.

If in fact all other players do defend theft rights, by returning a "NO" answer, the player holding the Lucky Planet card is allowed to take a second card from that same planet, as consolation. This will also apply where players have to favorable planet cards to give, though all players must be asked first. The player with the Lucky Planet card will only gain one planet card by this instruction, whether it be from a player, or from the planet as consolation.

Gifted

A player who receives a gift from another player via a Lucky Planet card, will be known as a "Gifted" player. (See Favors From The Universe). Players that end up taking a second card from the same planet (having gained none from other players) as consolation, will not be "Gifted".

Crew Bank and Buying Crew

Players start the game with 4 Crew Members: a CA (Celestial Astronaut), Navigator, Planetarian and a Scientist. The remaining Crew Members are shuffled and placed in the Crew container. This is known as Crew Bank. Players must return to Earth (home) with at least a CA and Navigator. The Crew Bank once shuffled, should remain in the same order, except for the taking out and addition of Crew Members. Members added to Crew Bank are always placed on top of the pack.

Players may buy/sell/exchange and dump Crew Members (see Dumping Crew) at the Crew Bank which is located at Earth's Moon. Earth's Moon can be reached by travel in normal play, by travelling The X Miles (Gateway No. 3), or via the Asteroid Belt. (See Asteroid Belt) The Benefactor may also take short cuts through their Star Locked Prism to reach it. (See Star Locked Prism and Benefactor) On travel to the Crew Bank players may do all: buy/sell/exchange/dump Crew, as many transactions as they wish, with as many Members as they wish, per visit. However players may also buy/sell and exchange Crew on their normal turn of play, without travel to the Moon, provided they hold a Scientist Crew Member. Though this method is restricted to one Crew Member bought/sold or exchanged per turn. If players choose to do Crew business this way, they must do so before they throw dice to move their shuttle. Players are not allowed to dump Crew Members on their turn of play—they must always travel to Earth's Moon to dump them. When players do not hold a Scientist, they may only do Crew business by travelling to Earth's Moon. This also applies if they hold the "Mad Scientist" (see Crew Member roles). Once at Earth's Moon players may conduct business whether they hold a Scientist, or not.

Buying/Exchanging Crew

When a player wants to buy/exchange Crew Members the player takes the Crew Bank cards, and keeping them in the same order, looks through the pack choosing and taking out the Members they want. The player will not show any new Crew Members to other players. The player pays the required amount in CC or VE's or exchanges Members (swapping one for another). The Members being put back in Crew Bank (sold/exchanged) must be displayed to other players before being placed on top of the pack.

Cost of Crew

One new Crew Member will cost one yellow CC counter or one VE card. Players may exchange one Crew Member for one other, as all Members are the same price. When players sell a Crew Member to Crew Bank, they receive one yellow CC counter.

Crew Members and Their Roles

There are 13 different Crew Members. They consist of Starting Members, Specialist Members and Hindering Members. Players may buy extra Crew Members throughout the game to help their play, within the holding limits. (See Holding Limits). The Crew Member roles are as follows:

Starting Members

CA—(Celestial Astronaut)

Flies the shuttle. Needed to go home.

Navigator

Navigates the journey. Needed to go home.

Planetarian

Planet Specialist. Needed to visit the planets. Players must always have this Crew card on show throughout the game, proving they are able to visit the planets. (Exception: when a player needs to hold up all their Crew Member Cards like a fan of playing cards, for another player to choose some to be lost).

Scientist

Crew Specialist. Needed to buy/sell/exchange Crew Members on a players normal turn of play, without the need to travel to Earth's Moon. When a player holds this number, they may buy/sell or exchange one Crew Member per turn in the Crew Bank if they wish. (If a player has no Scientist they will need! to travel to the Crew Bank, located at Earth's Moon to do so). Players using their Scientist on their turn in this way must do so before using dice to move their shuttle. If a player receives the Mod Scientist Crew Member from the Green Planet, their normal Scientists become dormant and may not be used to deal with Crew. (See Mad Scientist)

Alienator

Destroys Aliens. The holder of this Member will not fight battles with Aliens when they land on an Alien Attack star. This Crew Member is in the Fortune cards.

Benefactor

The Benefactor owns the Star Locked Prism. (See Star Locked Prism) The holder of this Member collects Cosmic Carbon from players that land inside the Prism. The holder may ignore card instructions to go into the Prism themselves, and they may use it for short cuts to and from Earth's Moon by travel through it, avoiding the Massive Black Hole.

Cometographer

Comet Specialist. The holder of this Member places 3 Comet Rings around any 3 Main Sequence stars in space. layers landing inside these rings pay the holder 3 CC for protection from the comets. The holder may ignore any comet card instructions. Where this Member is passed to another player, the new holder places the Comet Rings around new stars, if desired.

Futurist

Black Hole Specialist. The holder of this Member escapes the Black Holes at Level 3. Once on Level 3 in the Massive Hole, they immediately escape to the Future. Once on Level 3 in the Mini Hole, they immediately escape to Travel The X Miles With Options. (See Black Holes)

MG (Member of the Galaxy)

Asteroid Specialist. The holder of this Member travels up/down the Asteroid Belt whenever they wish. They can cut short their dice throw to gain access at any ABS, travel through the Belt and exit to continue with their remaining dice score. (See Asteroid Belt) The holder may ignore any asteroid card instructions.

Hindering Members

The 3 Hindering Crew Members can only be Dumped by visitation to Crew Bank at Earth's Moon. These Members are Green Mouse, Mad Scientist and Dork. They may be lost by chance along players travels, but if not they must be Dumped before players return home. (See Dumping Crew)

Green Mouse

Considered unlucky in space. This Member is picked up from the Green Planet. It has no function. Unable to take home—must be dumped. (There are 2 Green Mice in the pack of Green Planet cards)

Mad Scientist

When players receive the "Mad Scientist". it renders their other Scientists out of action and they will not be able to use them to do Crew business on their turn of play. Whilst holding this member any Crew business will be carried out by travel to Earth's Moon only. When players rid themselves of the Mad Scientist (either by chance or Dumping it) their other Scientists become normal and may be used again. This Member is picked up from the Green Planet. Unable to take home—must be Dumped. (There is one Mad Scientist in the peck of Green Planet cards) This Member counts as a Scientist for the holding limit of not more than 2 of the same Crew Member. It should be noted that players normal Scientists become dormant as soon as the Mad Scientist Crew Member is picked up. Therefore if players hold 2 Scientists already, the Mad Scientist puts them above the holding limit and one Scientist will have to be given up to Crew Bank. (See Holding Limits) Players are not allowed to give up the Mad Scientist however, as it can only be dumped.

Dork

Slows a player down. This Member is automatically picked up when players land on Planet Krod. A player carrying this Member has one move deducted from each dice throw. Thus, if the player throws a four, they may only move three light years, if they throw a six, they may only move five light years, and so on. Players lose the Dork by the throw of one (where they do not move at all, but their Dork disappears) or by the throw of five if they travel The X Miles Without Options, their Dork disappears. Hence the Member will probably be lost along the way, but players are not allowed to return home with it. (See Planet Krod and The Dork for full details)

CSM (Cloned Service Menial)

Serves no purpose. This Member is found in the Fortune cards and may be sold to Crew Bank for Cosmic Carbon.

Dumping Crew

Players are given two "Dump" tokens at the start of the game. Each time a player visits Earth's Moon to dump Crew, they hand in a Dump token. Players are only allowed two dumps per game, but they may dump as many Crew as they wish per dump visit. The 3 Crew Members that must be dumped are Green Mouse, Mad Scientist and Dork. When players receive any of these Members, they must be dumped, if not lost by chance, before returning home to Earth. These members can only be dumped, not bought, sold or exchanged. Though Dorks will probably be lost by chance before players need to dump them (See Planet Krod and Dork). Players would not wish to buy these Members as they are unlucky and hinder their play (see Crew Roles—Hindering Members).

Dumping can only be done by travelling to Earth's Moon. It is not allowed on a players normal turn of play, without visitation, by use of a Scientist. Players receive no payment for ridding themselves of these hindering Members. It should be noted that players are not restricted to how many times they visit Earth's Moon to buy/sell/exchange Crew Members, only dumping them. When a player wishes to dump a dumping Member, they travel to Earth's Moon, hand in a Dump token and place as many Crew Members as they wish on top of the Crew Bank card pack. They must display such Members to other players before placing them in Crew Bank. If a player has already made two dump visits and is unlucky enough to later gain a third dumping member, their only hope is to lose the Member by chance, (i.e., to be taken from them by another player, blind, or by way of an instruction card) as they will have no Dump tokens left and are unable to return home with it. Players returning to Earth with dumping Crew Members will be disqualified.

Holding Limits

Players must remember the rule: NOT MORE THAN TWO CODES AND CREW! Players are not allowed to collect more then two of the same code (number) card. On visit to a planet, if a player picks up a third same code card, it must immediately be put on the bottom of that planet pack, the player must leave the planet next turn as normal. Players are not allowed to hold more than two of the same Crew Member. On receipt of a third same Member, if the player has a Scientist, the third Member must be immediately sold to Crew Bank. If the player has no Scientist, the third Member must immediately be given up to Crew Bank, without any payment. (The holding of a Scientist allows instant Crew business on a players turn of play. Without one players would have Go travel to Earth's Moon to do so). the "Mad Scientist" still counts as a Scientist for this holding limit. (See Crew Member Roles)

The maximum holding of Crew Members per shuttle is ten. If a player receives more than ten Crew Members, the portion above ten are to be placed in Crew Bank, in accordance with the rule above. Players must return home to Earth with at least two Crew Members—these Members must be a CA and a Navigator. Holding Limits do not apply to Valuable Elements.

Exceeding The Holding Limits: Players found travelling with too many Crew Members are banished to the Green Planet. Their excess Members are given up to Crew Bank, not sold. They continue their play from the Green Planet, next turn.

Disqualification

Players found travelling with more than two of the same Code card are disqualified. Players returning home to Earth with an incorrect Code or Crew are disqualified. In both cases the game continues with the remaining players.

No CA/Navigators Left in Crew Bank

If a player needs to buy a CA Crew Member or a Navigator Crew Member in order to go home, because they do not hold any, and find that there are none left in the Crew Bank, the following rule applies: The player has to announce their journey home to other players, and the fact that they have to buy a CA/Navigator or both from another player. A player that holds 2 of the same sought after Member will have to sell to the requesting player. The cost will be 3 CC per Member. (No VE cards) If there are no obligating players that offer sale, all players holding 2 of the same sought after Member throw dice to determine the player. The player with the lowest score must sell their extra Member/s, ensuring that they still hold at least one for their own homeward journey. This player receives the Cosmic Carbon from the buying player. The buying/selling or Crew Members between players is only allowed under these circumstances.

Star Locked Prism

Players fall into the Star Locked Prism when they land upon the symbol which is situated at one end of the Prism. This symbol is connected by a dotted line which draws a players shuttle inside. Players may also receive a card instruction directing them into the Prism. Once inside the Prism a player escapes on their next turn by paying the Benefactor (player holding this Crew Member) Cosmic Carbon (one token). They then leave via the exit situated at the other end of the Prism. If the Benefactor Crew Member is not in play (still in Crew Bank), players inside miss a turn before exiting. Inside the Prism there is only enough space for one shuttle, therefore exchanging space may occur. The player that holds the card "GET OUT OF PRISM FREE" will not pay the Benefactor or miss a turn, they have immediate escape to Travel The X Miles With Options.

The Benefactor in the Star Locked Prism

The Benefactor owns the Star Locked Prism. Therefore the player holding this Member may use the Prism as a short cut (through it in two light years) to and from Earth's Moon, without passing the Massive Black Hole, i.e., a dice throw of two would move the player one on the Entrance symbol, which draws their shuttle inside, and two on the exit star outside the Prism. This player will be able to enter the Prism via the exit, and exit it via the entrance on a return journey from Earth's Moon. All other players can only leave via the exit of the Prism. The Benefactor may ignore any card instructions to go to the Prism if they wish.

The Black Holes

The Black Holes in space (on the board) consist of The Massive Black Hole (large) and The Mini Black Bole (small). Both Holes are made up of 1–6 Levels which work the same, except The Massive Hole contains an Event Horizon, where Levels 2 add 3 are different. (See Event Horizon). Players fall into a Black Hole when they land on either of the symbols outside, connected by dotted lines which draw them inside the mouth of the Hole. Players may also receive a card instruction directing them info a Black Hole at a certain Level. Once inside the Hole, a player's shuttle is placed on Level 6. The player sits on this Level until their next tern, when they throw the dice to try to escape. Players escape both Black Holes on the throw of a 5 or 6. The throw 5 sends players to Travel The X Miles (Without Options), and the throw 6 sends players back out the mouth of the Hole, travelling 6 light years. Levels 5 and 6 are called the Escape Velocity for this reason. If a player fails to throw a 5 or 6, they drop a level deeper in the Hole (their shuttle is placed on Level 5) where they sit until their next turn, when they throw the dice to try to escape. The player continues to throw the dice each turn, and on failing to escape, falls deeper and deeper into the Hole (Level by Level) until they reach Level 1—THE SINGULARITY.

At the Singularity (Level 1) players use different dice to try to escape: They ask The Powers That Be if the Black Hole is revolving, via the YES/NO dice. If a player throws a "Yes" (the Hole is revolving) the player escapes to Travel The X Miles With Options, via an imaginary bridge leading from the Singularity to center space Mark X (The player immediately travels these miles). If a player throws "No" (the Hole is not revolving) they fail to escape, remain at the Singularity, and try again next turn. The player now remains in the same position, continuing to ask "The Powers That Be" each turn, until they escape by the throw of "Yes". If a player is on Level 6 and another player falls into that same Black Bole via the mouth, the second player will fall deeper onto Level 5, as two shuttles are unable to occupy the same space. Exchange of Space may occur, however, where a player receives a card instruction sending them to a Black Hole Level which is already occupied, (See Exchange of Space section).

The game may contain Binary Black Holes (double)—where 2 Black Holes are positioned next to each other, or one inside the ether. Where the latter is the case, players at the Singularity will keep the same dice (normal, and fall into a second Hole, where they begin the Levels again, starting at Level 6. When they are at the Singularity for the second time, the rules are the same as a single Black Bole (change dice etc). Binary Black Holes may consist of 2 Massive or 2 Mini Black Holes, or one of each. Where players escape a Black Hole by a throw of 6, they may choose which mouth symbol (as above) to exit from.

The Event Horizon

The Massive Black Hole contains an Event Horizon. This surrounds Levels 2 and 3, and represents the 'Past' and 'Future'. When a player lands on Level 3 in the Massive Black Hole, they throw the dice to try to escape the Hole, as explained in the previous section. The throw of 5 sends the player to The X Miles, Without Options, just as before, but the throw of 6, is different. Once in the Event Horizon, players are unable to escape the Hole via its mouth. Therefore the throw of 6 at Level 3 sends the player TO THE FUTURE. and the throw of 6 at Level 2 sends the player TO THE PAST. This only applies in the Massive Black Hole, as the Mini Black Hole has no Event Horizon.

Escaping to the Future—in the Outer Horizon

When a player is on Level 3 of the Massive Black Hole and throws a 6, they escape the Black Hole by going into the Future. This means that they immediately go directly to the next planet they were planning to visit. (i.e., Their shuttle in placed on that planet and the player takes the relevant planet card). Their play continues from that planet next turn in normal play. Players can escape to Earth in this way, if that was their next one.

Escaping to the Past—in the inner Horizon

When a player is on Level 2 of the Massive Black Hole and throws a 6, they escape the Black Hole by going into The Past. This means that at an earlier time they would not have collected their last Planet card (Code or VE). Therefore they lose one of their Planet cards, by Aliens Choice. This lost card is cast out the game, and the player's shuttle is placed in the center of the board, to immediately Travel The X Miles With Options. If the player has not yet collected a Planet card, they must lose A Crew Member in the same way. (Aliens Choice and Travel The X Miles)

The "Futurist" in the Black Holes

The Futurist is the Black Hole Specialist and the player holding this Crew Member escapes both Black Holes at Level 3. When in the Massive Black Hole the Futurist sends the player to THE FUTURE. When in the Mini Black Hole, the Futurist sends the player to THE X MILES WITH OPTIONS (Centre Space).

The Asteriod Belt

This is the Belt that lies between Planets Mars and Jupiter in space and is full of Asteroids. Players may cross through it in normal play, or travel up and down it as a quicker route.

Both are done at an ABS (Asteroid Belt Station) of which there are four marked B, E, L and T, next to the symbol:

To Cross The Belt

Players may cross through the Belt at an ABS where there is a connecting ABS opposite (joined by a dotted line) for them 4 to cross onto. They may do this with their normal throw of dice; landing on the first ABS, the dotted line will draw their shuttle across the Belt onto the second ABS, counting as one light year only.

To Travel Up and Down The Belt

Players may travel up and down the Belt (inside it via the Asteroids) when they actually land on an ABS with their last move of dice throw. They may do this from any of the four ABS. When a player's last move of dice throw lands them on one of these ABS they can immediately travel inside the Belt, up or down, for as far as they want to go, and exit at another ABS. They do this all within one move, without further dice throw—as movement inside the Belt is continuous. Therefore players will never stop on any of the Asteroids.

The MG in the Asteroid Belt

The player holding the Crew Member MG (Member of the Galaxy), who is the Asteroid specialist, may travel up and down the Belt as they wish, without having to land on an ABS. They may cut short their dice throw, to gain access at one ABS, travel up/down the Belt and exit another ABS, then continue onward using their remaining dice score. Both the entrance and the exit ABS Count as one light year only. This player may also ignore any Asteroid card instructions, if they wish.

The Sun

Players do not land on the Sun. When they travel too close to it, and land on a SUN spot they take a Sun card and follow its instructions. (The Sun may or may not appear on the board; likewise with the Sun Spots, or these may appear alone without the actual Sun being visible).

Jupiter

Players do not land on Planet Jupiter. They travel round the King Gas Planet and when get too close, and land on a JUPITER SPOT they take a Jupiter card and follow its instructions. (Jupiter may or may not appear on the board; likewise with Jupiter Spots, or those may appear alone without the actual planet being visible).

The Green Plant

Players will not intentionally go to The Green Planet, as if contains no Code/VE cards and is home to Aliens. Players are taken to The Green Planet when they lose a battle with the Aliens, or by the throw of 12 when travelling The X Miles Without Options, or by an instruction card. Once on the Planet, players take a Green Planet cord and follow its instructions. They leave the Planet in normal play (via stars connected by straight lines). The Crew Members Green Mouse and Mad Scientist can be collected vie tile Green Planet cards if players are unlucky. Players should be careful when reading out the contents of Green Plane cards. If the card is one they need to keep, they should not make its contents known to other players, i.e., if other players know they hold a Green Mouse or Mad Scientist, they will not choose them as a player to take Crew Members from, should the situation arise. This would then reduce their chance of passing on these members, ultimately resulting in a trip to Earth's Moon to Dump them.

Planet Uranus—and the is it Safe Area

Planet Uranus is not on an eccentric tilt and at certain times it is unsafe to land there. Players have to "hover" (stop) on its surrounding "Is It Safe" area and ask The powers That Be whether it is a safe time to go. Players always have to stop on the "Is It Safe" area, cutting short their dice throw, to shake the YES/NO dice. If "Yes" is the answer, they immediately place their shuttle on Planet Uranus and take a Planet card. If "No" is the answer, they remain to try again next turn, or travel away. The exception to this is when players enter Uranus via The X Miles or card instruction, where they by-pass the area. The "Is It Safe" area is large enough for more than one shuttle.

The Spectroscope and Paths to Pluto

When players wish to travel to Pluto in normal play they must first stop at the Spectroscope. Star to use the Spectroscope (colored dice) to see which path to take. The exact number of dice throw is not needed to stop at this star, and if the throw is cut short players use tile Spectroscope immediately. The Spectroscope, or colored dice, contains different colors, i.e., Red, Yellow, Green, and Black. Each color corresponds to a path leading from Spectroscope Star to Planet Pluto. When a player stops at tile Spectroscope Star they throw the colored dice, and the color given is the color path they travel to and from Pluto, obeying any star instructions along the way. Normal dice is then used to travel this path. If a player travels to Pluto via The X Miles or card instruction they by-pass Spectroscope Star, and may choose their return from any of the paths. The RED PATH takes players through the Oscillating Ellipse (see Oscillating Ellipse). This path can also be accessed via a Worm Hole. The YELLOW PATH is the quickest and most direct route, covered in one 1 light year, it is called The Pluto Express. The GREEN PATH contains Alien Attack Stars. The BLACK PATH takes players past the mouth of the Mini Black Hole.

Planet Krod—and the Dork

Planet Krod is located in the center of the Whirlpool Galaxy. The Whirlpool Galaxy may consist of different colored star routs that meet. Where this is the case, players enter the Galaxy by stars of one colored route, travel to the middle, then exit by the stars of a different colored route, depending on which direction they wish to travel. Players pass over Planet Krod in this way, and are not affected. However, when their last move of dice throw actually lands them on the Planet, in the center, visiting Planet Krod rules apply.

Visiting Planet Krod

Whenever a player lands on Planet Krod (either by normal play, via The X Miles or by instruction card) they collect a Dork Crew Member, i.e., they are given a Dork Crew Member card and a Dork token is attached to their shuttle. This Dork now slows the player down by "one" each turn. (If the player throws a two, they can only move one light year, if they throw a four, they can only move three light years, and so on). Cards instructing players to move so many light/dark years are also reduced by one. There are 2 Dork Crew Members in the game. If both are in use and a third player lands on Planet Krod, they take the Dork from the player who has it first. The same player may receive 2 Dorks. If this happens, their scores are reduced by "two".

How to Lose the Dork

Players lose the Dork by the throw of either 5 or 1. The throw of 5 can take the player into the X Miles Without Options, thereby losing the Dork, and the throw of 1 would means the player will not move that turn, but will lose the Dork. When players lose the Dork, the Dork Crew Member card is handed in together with the Dork token from their shuttle. Dorks are not allowed in The X Miles and are automatically lost on the throw of 5 when a player decides to travel this way. However, if the player chooses not to travel The X Miles on the throw of 5, they keep their Dork and move four light years. Dorks may be passed onto other players when Crew Members are being taken by the Bind method, and when this happens the Dork token is placed on the new player's shuttle, slowing down their future scores. Where a player is unlucky enough to receive 2 Dorks, their throw of 1 will lose one Dork at a time, but their throw of 5 (if travelling The X Miles) will lose both at once. Players will not lose any Dorks by the throw of 2. They simply do not move that turn. Players are not allowed to return home with a Dork, which if not lost before, must be Dumped at Earth's Moon.

The Moons

Earth's Moon

This is the location of the Crew Bank. Players visit this Moon to do business with Crew Members. They may buy/sell/exchange and dump Crew here, carrying out as many transactions as they wish, per visit. When players do not hold a Scientist, or hold the "Mad" Scientist, they must visit Earth's Moon if they wish to do Crew business, being unable to do so on their normal turn of play (without visitation). Players can reach this Moon by travelling passed the Massive Black Hole, or by using the Asteroid Belt as a quicker route. They can also travel to it via The X Miles (Gateway 3), and the player that holds the Benefactor Crew Member may use the Star Locked Prism as a Short cut. Cosmic Carbon is not collected a Earth's Moon, only on sale of Crew. Once business is complete, players leave this Moon in Normal play on their next turn. Players are also sent here for Lunar Repairs to their shuttles on receipt of instruction cards.

Other Moons

The other 8 Moons are Ganymede, Callisto, Io, Europa, Amalthea, Titan, Triton and Charon. When players pass over any of these Moons they collect Cosmic Carbon (one yellow token per visit). This is the way to replenish space currency when running low.

Players only pass over these Moons rather than stop on them, except when an instruction card directs them to one. Therefore their same dice throw is continued beyond the Moon, once they have collected Cosmic Carbon. Thus, if a player throws a six, and it takes five light years to reach the Moon, they travel the five light years, land on the Moon to collect the Cosmic Carbon, then continue off the Moon with one light year. Their full dice throw must be used.

The Oscillating Ellipse

The Oscillating Ellipse is located on tile Red Path to Pluto. Inside strange phenomenon takes place (can be thought of as the space Bermuda Triangle), and shuttles landing therein will mean great advantage or greet loss to players. Nothing happens to players simply passing through the Ellipse, only when they actually land on one of the two Oscillating Stars inside.

Landing Inside The Ellipse

When a player lands on either one of the Oscillating Stars, they try their luck for the "Dupe" (Duplicate Shuttle). They immediately have 5 throws of 2 dice to try to achieve a double score. Failing this, on their next turn they move their shuttle onto tile other Oscillating Star and again have 5 throws of 2 dice. During any of these 10 throws, if the prayer achieves a doable score, they gain the Dupe (see next section), However, if they fail, they lose half of their Crew Members and these are taken from them by the Alien (blind). (An odd number of Crew is rounded down).

The Dupe (Duplicated Shuttle)

The Dupe is the black shuttle gained by a player who has achieved a double score in the Oscillating Ellipse. Once a player throws this double, tile Dupe is placed on the Spectroscope Star (for use next turn), and the player's original shuttle is placed in center space to Travel The X Miles With Options. The player continues pray with this shuttle to Travel The X Miles with 2 dice. (Shuttles on center space X always have immediate_travel). Then from their next turn, this player plays with two shuttles, their original and the Dupe. Thus the player will always throw 2 dice (using one dice score per shuttle), and may choose which shuttle to move to which dice score, after their throw.

This is of great advantage to the player, who now has double the chalice of being first to locate the Code. Both shuttles are classed as equal, and either may return home to Earth to win the game for that player.

When the player wishes one of their shuttles to Travel The X Miles Without Options (on the throw of 5) they place the shuttle on Gateway 1 and wait until their next turn, as normal. On their next turn their throw of 2 dice must operate this shuttle first to Travel The X Miles. The player will then need to throw one more dice that turn to operate their Dupe. Following turns will revert back to their throw of 2 dice, choosing which shuttle to move to which dice score.

How to Lose Dupe

Other players will not want a player to have such an advantage for too long. To make the Dupe disappear a player will need to pass through the Oscillating Space. Such a player will not need to land therein, just the passing through will make the Dupe disappear. (The black shuttle is removed from tile board, and the player that had it continues to play with only one dice for their original shuttle).

Obviously a player passing through the Ellipse to rid a player of the Dupe, is risking the fact that they may land inside, and end tip losing half their Crew. Then again, they may achieve a double score and take the Dupe for themselves. Players must weigh the risk of passing through the Ellipse to rob a player of such good advantage. It should be noted that if a player operating the Dupe passes either of their shuttles through the Ellipse, they cancel out their own Dupe and lose it.

Space Miles

When players use 2 dice and achieve a double score, they may choose to buy Space Miles if they wish (exceptions:

inside Oscillating Ellipse, and on the throw of double 5—see both sections). If players do decide to buy Space Miles they must do so before using their double score to move that turn. The cost of all Space Miles is 2 CC. Space Miles double a player's score when they use one dice in normal play. When a player buys the Space Miles token No. 2 they are buying 2 light years worth of Space Miles, when a player buys the Space Miles token No. 3 they are buying 3 light years worth of Space Miles, and so on. These extra miles ace added to their scores when they throw the corresponding number when using one dice.

For instance, if a player throws double 3 and decides to buy Space Miles, they pay 2 CC and are given the Space Mile token No. 3. They move their shuttle to the double score as normal, hereafter whenever that player throws 3 with one dice, they may move 3 or 6 light years (using their Space Miles). Similarly if a player throws double 6 and decides to buy Space Miles, they pay 2 CC and are given the Space Mile token No. 6 (as a reminder that they own these miles). Each subsequent throw of 6 gives that player the option to move either 6 or 12 light years. The player may choose whether to use their Space Miles or not. Thus, they may keep them out of trouble or simply quicken their pace. Should they decide to use their miles they simply announce the fact out loud as they move their shuttle. It is the player's responsibility to remember to use any Space Miles they own. Players may only buy one token of Space Miles each. Once a token has been sold, future players throwing that same double score will not be able to buy those miles.

Space Miles remain the property of the first player to buy them for the entire game and may be used as many times as the player wishes. When a player has just purchased Space Miles, they may continue play using their double score to move their shuttle, or choose to throw the two dice again. Players have the chance to buy Space Miles (on achievement of a double score) when they are in Zephonice Overdrive (ZO), Battles With Aliens and Travelling The X Miles, all of which require the use of two dice.

Favors From the Universe

The Fortune pack of cards contain Favors from The Universe. Such cards read: "YOU MAY ASK A FAVOR FROM THE UNIVERSE." When a player receives this card they may choose one from the list of five permitted favors, as follows:

1. Togo to any Planet.
2. To go into Worm Hole Zone.
3. To use ZO (Zephonic Overdrive).
4. To collect/dump a free Crew Member via Crew Bank.
5. To claim a Planet card from a "Gifted" player (Blind), Any one of the above favors are immediately granted to a player receiving a Favors From The Universe card, their shuttle is moved accordingly, and or relevant cards collected.

The following should be noted:

Favor 4: will be granted without the use of travel, dump token, or Scientist. when a player chooses to collect a free Crew Member, they make their choice from all Members in the Crew Bank.

Favor 5: will only be granted when there are "Gifted" players in the game. Players are classed as gifted when they have received a planet card, by way of a gift, from another player, following receipt of the Lucky Planet card. (See Planet Cards) In this instance when player chooses Favor 5, they must claim their planet card from a gifted player by way of the Blind method. (See Blind).

Throwing Double Five

When players throw two dice end get double five (the sign of the X twice), it is considered the best dice throw in the game. Players will have the choice of whether to move their shuttle to center Space to Travel The X Miles With Options, or continue play from their present position. If they choose to Travel The X Miles With Options, they do this immediately, again using two dice.

Advantage Situations:

1. When in ZO, a player throwing double five may choose to Travel The X Miles With Options, or travel ten light years.

2. When in battles with Aliens, a player throwing double five will always win the battle (it will beat the score of double six). With the battle won, the player may choose to Travel The X Miles With Options, or travel ten light years.

3. When on Gateway 1 of the X Miles Without Options, a player throwing double five may change their shuttle position to center Space to Travel The X Miles With Options, or simply move to Gateway 10 to enter the Oscillating Ellipse.

4. When a player holding the Dupe (running two shuttles) throws double fine, they may choose to place one shuttle in center Space to Travel The X Miles With Options, and one shuttle in Gateway 1 to Travel The X Miles Without Options, or either one of these. Alternatively they may travel five light years with either or both shuttles.

Phase 2

Though the game has been made to consist of two Phases, each individual game may not always turn into Phase 2. A game turns into Phase 2 by chance, on the receipt of the Phase 2 card. Once into Phase 2, the object completely changes: it is now a race back home to Earth, and the winner is the player holding the most Cosmic Carbon/Valuable Elements, when the first shuttle reaches Earth. Coded (number) cards become worthless in this Phase and all the Planets close. Players are not allowed to visit the planets unless if is out of their control, i.e., via an instruction card.

Players will not know whether a game may or may not turn into Phase 2 and must base their skilful play on the event of either being the case. The winner of a Phase 2 game may be a different player to one looking favorite in Phase 1. Thus the Phase 2 card may be considered a threat hanging over a Phase 1 game, which adds to the intrigue. However, as it will become apparent on playing, it is not intended to be turned into Phase 2 early on in the duration of a game. Therefore if the Phase 2 card surfaces early, it should be ignored and placed to the bottom of the pack. (Players may decide the definition of "early", for instance they may consider it to mean within the first half hour of play).

The Phase 2 CARD

The Phase 2 card As located in the Fate & Fortune pack. It reads: "YOU PLAY A HAND IN THE FATE OF THE UNIVERSE. WILL IT CHOSE? ASK THE POWERS THAT BE." On receipt of this card the player throws the YES/NO dice to see if the Universe will close. If "YES", it will close, the game turns into Phase 2, if "NO", it will not close, the game continues in Phase 1 and the card is placed to the bottom of the pack. When the Universe is closing (Phase 2) players immediately Start the race back to Earth. To Win a Phase 2 Game Valuable Elements are double the value of Cosmic Carbon in Phase 2. Thus, if a player holds 3 VE cards they are worth 6 CC. The first player home to Earth receives 5 CC to add to their score and has first chance to name Planet X. (See Planet X) Following the Planet X statements, all players wealth is totaled (Cosmic Carbon/Valuable Elements) and the winner is the one that holds most.

Planet X

The seven favorable planets are Mercury, Venus, Mars, Saturn, Uranus, Neptune and Pluto. Players visit these planets to collect "The Code". Planet X will be one of these planets, but will be the one that contains no Codes (number cards). Planet X will only contain 16 Valuable Elements and 2 Personal Planet cards. By process of elimination players can work out which planet is Planet X. It will help to remember the format of the planet cards, i.e. 18 cards in each planet, consisting of 12 Codes, 4 Valuable Elements and 2 Personal Planet cards, except in Planet X.

Players may also look for clues from other players visiting planets to collect their player cards, by way of their comments and facial expression. It is advantageous for players to locate Planet X in both Phases of the game. In Phase 1, it will save time not having to re-visit that planet. In Phase 2, it may result in the chance to gain extra Cosmic Carbon. In a Phase 2 game the first player to reach Earth states which planet they think is Planet X. The named planet's cards are then inspected by this player, and if correct the player receives 5 CC to add to their score. If the player is incorrect, play passes to the left for the next player to state which planet they think is Planet X. The named planet's cards are inspected by this player and so on. This continues until either a player collects the Cosmic Carbon, or all the players have had the chance to guess Planet X. Only one guess is allowed per player.

Quick Glance Guide Card

Travel the X Miles:

On throw of '5' players may Travel The X Miles Without Options

Holding Limits: Not more than 2 Codes and Crew (same) Maximum Crew per shuttle=10

Crew to Return Home:

CA

Navigator

Cost of Crew:

CC counter/1 VE card per Member

Buy one on turn of play (with Scientist)

Buy more on travel to Earth's Moon (without Scientist)

Cost of Space Miles:

2 CC per token (double score)

Players limited to one token

When To Use 2 Dice:

ZO

Battles with Aliens

Traveling The X Miles

Lucky Planet Card:

Request gift from another player (Code/VE)

Nominated player defends rights (Powers That Be)

Gifted:

Player that has received a gift from another player (via Lucky Planet card)

Oscillating Ellipse:

5 throws of 2 dice on first star—repeat next turn on second star (to gain Dupe/lose Crew)

Favors From THE Universe:

1. To go to any Planet
2. To go into Worm Hole Zone
3. To use ZO (Zaptonic Overdrive)
4. To collect/dump a free Crew Member via Crew Bank
5. To claim A Planet card from a 'Gifted' player (Blind)

Phase 2 Card:

When Powers That Be=Yes (Universe to close) game turns into Phase 2

Variations in Play

If a quicker game is desired, players may decide to play with a 3 digits Code rather than the 4 digits. In such cases, at the start of play when players throw dice to determine the starting player, and the Code, only the first 3 numbers thrown are recorded on paper, and called "The Code" to be collected. It should be noted that this 3 digit Code will need to be a valid Code to play. (See The Code)

Card Contents

All card instructions must be obeyed unless players hold cards which exempt them from certain conditions. Where players move to other parts of space following card instructions, they continue in normal play from their new position. Some cards will read "KEEP THIS CARD" and players do so for use later in the game when they so desire. Such cards may only be used once unless they skate otherwise. All used cards can be placed to the bottom of their pack, or alternatively cask out the game. Some cards will be actual 'Crew Members' which players keep as park of their Crew cards. When cards direct players to move so many 'Dark Years' and their backward movement land them back onto a planet/place, they stop there, and normal rules apply for that planet/place (i.e. they hake a planet card, etc.). They will not continue any backward movement beyond that planet/place. This also applies to Worm Holes, where players will shop in the Worm Hole Zone until their next turn, when they exit from their chosen Worm Hole. Factual information is contained on some cards for players interest only.

The following lists the card contents and describes their meaning:

Fate & Fortune

FATE

ALIEN ATTACK. BATTLE OR CHANGE DIRECTION. Players may choose whether to start battle with the Aliens, or travel in the opposite direction (backwards from where they came) on their next turn.

ANOMALIES IN DATA RECEPTION. LAND NOW AT YOUR NEAREST PLANET. Players place their shuttle on the nearest planet and take a Planet card, if applicable.

A SPACE TUNNEL LEADS YOU 5 LIGHT YEARS. Players move forward by 5 stars.

BETELGEUSE* MAY EXPLODE. TRAVEL 5 PARSECS. (*ONE OF THE LARGEST STARS IN THE UNIVERSE; 17000 TIMES BRIGHTER THAN OUR SUN) Players move forward by 15 stars (or less if they reach a planet/place) (1 parsec=3 light years).

BOK GLOBULES* AHEAD. TRAVEL 4 DARK YEARS. (*GAS AND DUST BEING PROCESSED TO BECOME A STAR.) Players move backward by 4 stars.

CLOSE COMET. COLLECT A CREW MEMBER FROM TOP OF CREW BANK TO HELP. Players fake a Crew Member card from the top of the Crew Bank pack.

ERRATIC ASTEROID. TRAVEL 2 PARSECS. (FACT: THE WORD ASTEROID MEANS 'LIKE STARS', THE NAME GIVEN BECAUSE THEY SHINE.) Players move forward by 6 stars.

ILLNESS: ECHO FROM A DISTANT BLAST CAUSES TEMPORARY DEAFNESS TO CREW. MISS A GO. Players miss one turn.

ILLNESS: SCIENTIST IN A STATE OF DESPAIR. TRAVEL 6 DARK YEARS. Players move backward by 6 stars.

ON-COMING COMET. TRAVEL 3 DARK YEARS. Players move backward by 3 stars.

PHASE 2. YOU PLAY A HAND IN THE FATE OF THE UNIVERSE. WILL IT CLOSE? ASK THE POWERS THAT BE. (See Phase 2 Section for details)

PLANETARY NEBULA* AFFECTS MATTER TRANSMITTER. TRAVEL 2 LIGHT YEARS. (*LAYERS OF GLOWING GAS PUFFED INTO SPACE FROM A DYING STAR.) Players move forward by 2 stars.

REMOTE QUASAR* CAUSES DATA INTERFERENCE. TRAVEL 12 DARK YEARS. (*THE MOST POWERFUL STAR LIKE OBJECTS IN THE UNIVERSE.) Players move backward by 12 stars.

SUDDEN POWER SURGE—ENGAGE ZO FOR AS FAR AS YOU WANT TO TRAVEL. Players move on to where they are going directly to a planet and take a Planet card, if applicable.

UNPREDICTABLE DARK MASTER FORCES YOU INTO THE NEAREST BLACK HOLE. Players move their shuttle To Level 6 of The Black Hole nearest to them.

FORTUNE

CANCELS A TRIP TO THE GREEN PLANET—MAY BE USED AFTER BATTLE. KEEP THIS CARD. Players keep for later use. May be used after losing a battle with Aliens, when Travelling The X Miles Without Options, or upon receipt of instruction card.

CREW MEMBER: ALIENATOR. KEEP THIS CARD. ROLE: DESTROYS ALIENS. IGNORE BATTLES. Players keep and place with other Crew cards; They may ignore Alien Attack stars when they land on them.

CREW MEMBER: C.S.M. (CLONED SERVICE MENIAL) KEEP THIS CARD ROLE: SERVES NO PURPOSE. Players keep and place with other Crew cards.

GET OUT OF PRISM FREE—IMMEDIATE ESCAPE TO TRAVEL THE X MILES WITH OPTIONS. KEEP THIS CARD. Players keep for later use, when they are sent to the Star Locked Prism.

MAJESTIC FORCES PROTECT YOUR SHUTTLE. NO NEED FOR LUNAR REPAIRS. KEEP THIS CARD (CONTINUOUS USE). Players keep for later use. May ignore all Lunar Repair instructions.

QUASAR POWER. CANCELS ANY INSTRUCTION. KEEP THIS CARD (USE TWICE). Players keep for later use to ignore any instruction. May re-use once.

SHARE THE WEALTH. TRAVEL 3 PARSECS AND COLLECT COSMIC CARBON. Players move forward by 9 stars (or less) and gain one yellow counter of CC.

SPACE REGULATIONS SHOW YOU HAVE BEEN MISSTREATED. ALL SHUTTLES CONSULT THE POWERS THAT BE TO SEE IF THEY PAY YOU COSMIC CARBON. All other players throw the YES/NO dice. If YES they pay the player CC, if NO they do not pay.

YOU FIND A ROCK OF SLATE—SAID TO COME FROM A URANUS COLLISION EARLIER IN HISTORY AND EXCHANGE IT FOR 3 CC. Players gain 3 yellow counters of Cosmic Carbon.

YOU GAIN E.S.P* TO MAKE YOU FREE FROM ILLNESS/VIRUS. KEEP THIS CARD. (*ESSENTIAL SPACE PROTECTION.) (CONTINUOUS USE). Players ignore all illness/virus instructions.

YOU HAVE ENTERED THE CONSTELLATION OF YOUR BIRTH SIGN. COLLECT COSMIC CARBON. Players gain one yellow counter of Cosmic Carbon.

YOU MAY ASK A FAVOR FROM THE UNIVERSE. There are 4 of these cards. (See Favors From The Universe section).

Destiny

DOOMED

A COMET HAS HIT YOU. GO TO THE MOON FOR LUNAR REPAIRS. Players place their shuttle on Earth's Moon, and conduct Crew business if they wish.

ANOTHER SPACE SHUTTLE IS HOSTILE. YOU HAVE THE POWER TO SEND THEM TO THE STAR LOCKED PRISM. CHOOSE A SHUTTLE OR GO YOURSELF. Player chooses a shuttle to be placed in the Star Locked Prism.

A SUPERNOVA* PROPELS YOU INTO THE OSCILLATING ELLIPSE. (*COLOSSAL STELLAR EXPLOSION.) Players place their shuttle in the Oscillating Ellipse and begin their 5 throws of 2 dice (see Oscillating Ellipse).

CROOKED ALIENS HOVER. PAY THEM OFF WITH COSMIC CARBON OR BATTLE. Players pay CC or begin battle with the Aliens. DOUBLE DOOMED? ASK THE POWERS THAT BE. IF YES=TAKE ANOTHER CARD NOW+ONE NEXT TURN. IF NO=YOU ARE DOOM FREE! Players throw the YES/NO dice. If YES they immediately take another card, follow its instructions and repeat next turn. If No they do not take further cards.

ILLNESS: NEARBY NOVA*: ALL CREW NEED SKIN GRAFTS. MISS A GO. (*AN ERUPTING STAR.) Players miss one turn.

SOLAR WINDS: CARRY YOU TO CALLISTO (MOON OF JUPITER). Players place their shuttle on Callisto and collect CC. (one yellow counter of Cosmic Carbon is collected at ail Moons except Earth's).

SOLAR WINDS:* CARRY YOU TO CHARON (MOON OF PLUTO). (*CONSTANT STREAM OF PARTICLES BLOWN THROUGHOUT SPACE FROM THE SUN.) Players place their shuttle on Charon and collect CC.

SOLAR WINDS: CARRY YOU TO LEVEL 3 OF THE MASSIVE BLACK HOLE* —THE EVENT HORIZON. (*A GAPING VOID IN SPACE THAT SUCKS IN AND DEVOURS THINGS THAT GET TOO CLOSE.) Players place their shuttle in the Massive Black Hole—Level 3. (See Black Holes).

SOLAR WINDS: CARRY YOU TO LEVEL 4 OF THE MINI BLACK HOLE. (FACT THE CENTER OF A BLACK HOLE IS CALLED THE SINGULARITY.) Players place their shuttle in the Mini Black Hole—Level 4. (See Black Holes).

SOLAR WINDS: CARRY YOU TO PLANET KROD. "AND MAY THE DORK CO WITH YOU". Players place their shuttle on Planet Krod where visiting Planet Krod rules apply. (See Planet Krod and the Dork section).

SOLAR WINDS: CARRY YOU TO TITAN (MOON OF SATURN). Players place their shuttle on Titan and collect CC.

SOLAR WINDS: CARRY YOU TO TRITON* (MOON OF NEPTUNE). (*HAS THE COLDEST SURFACE TEMPERATURES IN THE SOLAR SYSTEM—FROZEN NITROGEN.) Players place their shuttle on Triton and collect CC.

STELLAR WIND: TRAVEL A DARK YEAR. Players move backward by 1 star.

THE ZODIAC IS UNSTABLE. GO TO A PLANET OUTSIDE IT (PLUTO, GREEN PLANET OR KROD) IF YOU HAVE VISITED ONE, YOU MUST CHOOSE ANOTHER. Players place their shuttle on the chosen planet and take a planet card, if applicable. If all have been visited, they must choose one.

TELEPORT

A CREW MEMBER IS ACCIDENTALLY JETTISONED INTO SPACE (ALIENS CHOICE). Player loses a Crew Member selected by the player seated opposite (Alien). The Alien chooses the Crew Member from the player that holds up all their Crew cards, facing towards themselves, like a fan of playing cards. The lost Member is placed on top of Crew Bank.

ALIENS KIDNAP A CREW MEMBER AND TELEPORT THEM TO ANOTHER SHUTTLE (ALIENS CHOICE). Player loses a Crew Member selected by the Alien (as above). The Alien passes the lost Member to another player without looking at the card.

ALIENS TAKE OVER YOUR SHUTTLE (SWAP ALL CREW WITH THE ALIEN). Player exchanges all their Crew Member cards with the player seated opposite.

SPACE MATTER ON YOUR SHUTTLE CAUSES OVERLOAD. EJECT A CREW MEMBER OR PAY COSMIC CARBON. Player chooses to either lose a Crew remember of their choice or pay one counter of Cosmic Carbon.

TELEPORT A CREW MEMBER IN FROM A SHUTTLE OF YOUR CHOICE (BLIND). Player selects a Crew Member from a chosen player who holds up all their Crew Member cards, facing towards themselves, like a fan of playing cards. The player keeps the Member.

TELEPORT A CREW MEMBER IN FROM ALL OTHER SHUTTLES (BLIND). Player selects a Crew Member from all other players (as above). The player keeps the Members.

TELEPORT A CREW MEMBER IN FROM A SHUTTLE OF YOUR CHOICE—BUT THAT SHUTTLE CHOOSES THE MEMBER. Player chooses the player they want a Crew Member from, and the chosen player selects which of their Crew Members to give them.

TELEPORT 2 CREW MEMBERS IN FROM SHUTTLE/S OF YOUR CHOICE (BLIND). Player may choose to receive 2 Crew Members from the same player, or 1 Crew Member from two different players (Blind as above).

TELEPORT A CREW MEMBER OF YOUR CHOICE TO ANOTHER SHUTTLE. Player selects one of their Crew Members to give to a chosen player.

TRAVEL THE X MILES (WITH OPTIONS). Player places their shuttle on center space Mark X to immediately Travel The X Miles With Options. (See Travelling The X Miles). There are four of these cards in the Teleport pack.

TELEPORT TO A PLANET OF YOUR CHOICE. Player places their shuttle on a chosen planet and takes a planet card, if applicable.

YOU HAVE BROKEN A SPACE LAW PAY COSMIC CARBON. Player hands in one yellow counter of CC.

Sun

ACTIVE ZONES ERUPT HELIUM GAS AND YOUR LAUGHING CREW TELEPORT YOU 'TO PLANET KROD. "AND MAY THE DORK GO WITH YOU". Players place their shuttle on Planet Krod where visiting Planet Krod rules apply. (See Planet Krod and q]le Dork section).

CORONAL MASS EJECTION* BOILING GLOBULES HIT AND MELT YOUR HEAT SHIELD. GO TO THE MOON FOR LUNAR REPAIRS. (*MAJOR ERUPTIONS OF EXPLODING PLASMA.) Players place their shuttle on Earth's Moon and conduct Crew business if they wish.

ILLNESS:

PASSING THROUGH GAMMA RAYS YOUR CREW ARE BATHED IN LETHAL DOSES OF RADIATION. WILL YOU LOSE ONE? ASK THE POWERS THAT BE. (ALIENS CHOICE). Players throw the YES/NO dice. If YES they lose one Crew Member (to be chosen by the player seated opposite—Alien). If No they do not lose any.

ITS A RICH SUN THIS YEAR. COLLECT COSMIC CARBON. (FACT: OUR SUN COULD HOLD A MILLION EARTH SIZED PLANETS INSIDE IT.) Players gain one yellow counter of CC.

ITS THE YEARS OF THE QUIET SUN. YOU CAN IGNORE ALL SUN/JUPITER SPOTS. KEEP THIS CARD (CONTINUOUS USE). (FACT: THE SUN IS A STAR.) Players will not take Sun or Jupiter cards when they land upon their spots.

NUCLEAR POWERED PARTICLES SOAR ACROSS SPACE TAKING YOU WITH THEM TO TRAVEL THE X MILES (WITH OPTIONS). Players place their shuttle on center space Mark X to immediately Travel The X Miles With Options. (See Travelling The X Miles).

SOLAR FLARE* SENDS CREW TEMPORARY COLOR BLIND. LAND AT MARS TO RECOVER. (*SUDDEN BURST OF ULTRAVIOLET PLASMA.) Players place their shuttle on Mars and take a planet card.

SUN RAPTURE: YOU DREAM OF GAINING A PLANET CARD WITHOUT TRAVELLING TO IT. ASK THE POWERS THAT BE TO GRANT YOUR DREAM? IF YES=COLLECT A PLANET CARD FROM ANY PLANET. Players throw the YES/NO dice. If YES they take a planet card from any Planet. If NO, nothing happens.

SUN STORM*: CARRIES YOU INTO THE STAR LOCKED PRISM. (*VAST CLOUDS OF PLASMA GIVEN OFF THE SUN.) (FACT: SUN STORMS (OCCUR EVERY 11 YEARS AND HELP TO CLEAR SPACE DEBRIS. Players place their shuttle in the Star Locked Prism (see Star Locked Prism).

SUPER SOLAR WINDS: CARRY YOU TO A PLANET OF YOUR CHOICE. (FACT: ALL THE PLANETS IN OUR SOLAR SYSTEM ORBIT THE SUN.) Players place their shuttle on a chosen planet and hake a planet card, if applicable. YOU ARE ON A DORMANT SPOT. WELL DONE! (FACT: WHEN GALILEO DISCOVERED SUN SPOTS IT PROVED THE SUN WAS SPINNING.) Nothing happens to players.

Jupiter

A CONFUSED WHIRLWIND IN THE GREAT RED SPOT* SWEEPS YOU TO YOUR DESTINATION. (* A HURRICANE 3 TIMES THE SIZE OF EARTH.) Players place their shuttle on a chosen planet and take a planet card if applicable.

HAVING DODGED RADIO-ACTIVE SOUTH TROPICAL ZONES YOU LAND AT AMALTHEA AND REST.

(FACT: JUPITER IS MOSTLY A GAS PLANET BUT ITS HARD CORE CENTER IS BIGGER THAN EARTH) Players place their shuttle on moon Amalthea and collect CC.

ILLNESS: ENTERING THE MAGNETOSPHERE—SHOCK WAVES AFFECT YOUR CREW WHO TELEPORT YOU TO A SUN SPOT. (FACT: JUPITER'S INTENSE MAGNETIC FIELDS SPAN 7 MILLION MILES.) Players choose a Sun spot upon which to place their shuttle and take a Sun card.

JUPITER IS IN CONJUNCTION WITH SATURN. THIS HELP SENDS YOU DIRECT TO THE PLANET. (FACT: JUPITER HAS AT LEAST 16 MOONS.) Players place their shuttle on Saturn and take a planet card.

JUPITER WORLDS CENTRIFUGAL FORCES SPIN YOU THROUGH ACID VAPORS THAT SHRINK YOUR SHUTTLE. GO TO THE MOON FOR LUNAR REPAIRS. (FACT: JUPITER SHRINKS A FEW MILLIMETERS EACH YEAR. ITS FAMOUS RED SPOT IS HALF THE SIZE IT WAS 100 YEARS AGO. Players place, their shuttle on Earth's Moon and conduct Crew business if they wish.

OCEANS OF LIQUID HYDROGEN SAIL YOU TO EUROPA WHERE ALIENS AWAIT. PREPARE TO BATTLE. (FACT: EUROPA IS AN ICE MOON WITH POSSIBLE UNDERGROUND OCEANS.) Players place their shuttle on moon Europa, collect CC and begin tattle with the Aliens.

PASSING COMETS: BUT JUPITER WILL DESTROY THEM. YOU ARE SAFE. (FACT: JUPITER IS MORE THAN TWICE THE SIZE OF ALL THE OTHER PLANETS IN THE SOLAR SYSTEM PUT TOGETHER.) Nothing happens to players.

SPIRALING THROUGH A VORTEX OF SUPER HEATED AMMONIA YOU CONSULT THE POWERS THAT BE FOR HELP. IF YES=THEY HELP YOU TO A PLANET OF YOUR CHOICE. IF NO=YOU REMAIN TO TAKE ANOTHER CARD. Players throw the YES/NO dice. If YES they place their shuttle on a chosen planet and take a planet card. If NO they take another Jupiter card.

SWALLOWED BY JUPITER'S CHURNING ATMOSPHERE YOU ORBIT THE PLANET AND MISS 2 TURNS. (FACT: 4 OF JUPITER'S MOONS ARE THE SIZE OF PLANETS. Players miss 2 turns.

SWIRLING BANDS FROM JUPITER'S RAPID RATE OF SPIN FORCE TO LAND AT 10. (FACT: MOON IO IS COMPLETELY COVERED IN VOLCANOES.) Players place their shuttle on IO and collect CC.

THE KING GAS GIANT HAS SUCKED YOU IN LIKE A COSMIC HOOVER AND SPITS YOU OUT TO LAND AT GANYMEDE*, THE LARGEST MOON IN THE SOLAR SYSTEM. Players place their shuttle on Ganymede and collect CC.

TROJANS* BEHIND. TRAVEL 2 PARSECS. (*GROUPS OF ASTEROIDS LYING IN JUPITER'S ORBIT.) Players move forward by 6 stars.

UNBEKNOWN CHEMISTRIES BETWEEN ZONES AND BELTS CATAPULT YOU INTO THE X MILES (WITH OPTIONS). (FACT: JUPITER HAS THE GREATEST STORMS IN THE SOLAR SYSTEM; THEY CAN LAST FOR 300 YEARS.) Players place their shuttle on center space Mark X to immediately Travel The X Miles With Options. (See Travelling The X Miles).

YOU HAVE ENTERED THE JOVIAN ATMOSPHERE AT THE CORRECT ANGLE. TRAVEL A PARSEC. (FACT: A PARSEC=3.26 LIGHT YEARS.) Players move forward by 3 stars.

WANDERING ASTEROID. COLLECT A CREW MEMBER FROM TOP OF CREW BANK TO HELP. (FACT: JUPITER COULD HOLD 1000 EARTH SIZED PLANETS INSIDE IT.) Players take a Crew Member card from the top of the Crew Bank pack.

Green Planet

ALIEN MESSAGE: DO NOT RETURN TO OUR PLANET. KEEP THIS CARD (MAY BE USED AFTER BATTLE) Players keep for later use. They will not have to visit the Green Planet.

ALIENS HOLD YOU BACK. YOU MUST WIN A BATTLE TO ESCAPE. BEGIN NOW (1 BATTLE PER TURN). Players begin battle and only leave the Planet when they win one. (They leave using their winning score).

CREW MEMBER: GREEN MOUSE. KEEP THIS CARD. ROLE: UNLUCKY AND UNABLE TO GO HOME. Players keep and place with their other Crew Members. (There are 2 of these cards in the pack).

CREW MEMBER: MAD SCIENTIST. KEEP THIS CARD. ILLNESS: ECCENTRIC VIRUS SENDS YOUR SCIENTISTS MAD. ROLE: RENDERS SCIENTISTS OUT OF ACTION. UNABLE TO GO HOME. Players keep and place with their other Crew Members. (They will not be able to use their Scientists for Crew business when they bold this card).

FREE PASS. FRIENDLY ALIENS WELCOME YOU TO VISIT WITHOUT TAKING A PLANET CARD. KEEP THIS CARD. Players keep for later use. When they go to the Green Planet they will not take a Green Planet card.

GREEN SUITS YOU. TRAVEL A PARSEC. Players move forward by 3 stars.

ILLNESS: EERIE INFECTION TAKES 2 CREW MEMBERS (ALIENS CHOICE). The player seated opposite (Alien) selects 2 Crew Members to be lost from the player who holds up all their Crew (facing towards themselves) like a fan of playing cards. The lost Members are placed in Crew Bank.

NO-ONE IN SIGHT. LEAVE NOW AT YOUR OWN SPEED. Players immediately leave the planet using one dice in Normal play.

ON LANDING YOUR CONTROLS LOCK ON ZEPHONIC OVERDRIVE. LEAVE IMMEDIATELY. Players immediately leave the planet using 2 dice.

THE PLANET IS QUIET. BY LEAVING NOW YOU MISS ALL HAZARDS. FOR IMMEDIATE DEPARTURE SCORE 6 OR MORE (USE ZO). FAILING THIS YOU TAKE ANOTHER CARD. Players use 2 dice and if score is 6+they use it to leave the planet immediately. If less than 6 they take another card.

VOLATILE MOUNTAINS. TO DEPART SAFELY YOU MUST BE SLOW AND THROW A ONE TO LEAVE NEXT GO. (5 CHANCES PER TURN). On players next turn they have 5 chances to throw a one to leave the planet. If they fail they repeat next turn, and so on, until they leave via 1 light year.

WICKED ALIENS KEEP A CREW MEMBER FOR EXPERIMENTAL USE (ALIENS CHOICE). The player seated opposite (Alien) selects a Crew Member to be lost from the player (as above). The lost Member is placed in Crew Bank.

Personal Planet Cards

MERCURY TAKE ANOTHER CARD. WEIRD TERRAIN. DEPART NOW. (FACT: MERCURY LIKE VENUS

HAS NO MOONS.) Players take another Mercury card and immediately leave the planet in Normal play. THIS IS YOUR LUCKY PLANET. YOU GAIN A GIFT FROM? (CHOOSE SHUTTLE) (FACT: MERCURY IS THE NEAREST PLANET TO OUR SUN.) (See Planet Cards section).

VENUS

TAKE ANOTHER CARD. THE ELECTRIC DRAGON OF VENUS* GREETS YOU. LEAVE NOW VIA ZO (*CONTINUOUS DRY LIGHTENING. (FACT: VENUSIAN SURFACE TEMPERATURES CAN REACH 1000 DEGREES F.) Players take another Venus card and immediately leave the planet using 2 dice.

THIS IS YOUR LUCKY PLANET. YOU GAIN A GIFT FROM? (CHOOSE SHUTTLE) (FACT: A VENUS DAY IS LONGER THAN ITS YEAR.) (See Planet Cards section).

MARS

TAKE ANOTHER CARD. EXCITED MARTIANS GREET YOU WITH PROOF OF THEIR EXISTENCE. COLLECT 2 CC. (FACT: KNOWN AS THE RED PLANET MARS HAS RED SKIES AT NOON AND BLUE AT SUNSET. Players take another Mars card and gain 2 counters of Cosmic Carbon, MARSQUAKE. LEAVE NOW VIA ZO (FACT: MARS HAS A GIGANTIC VOLCANO (OLYMPUS MONS) AND GREAT RED DUST STORMS. Players immediately leave the planet in Normal play.

SATURN

TAKE ANOTHER CARD. YOU LEAVE NOW BUT SATURN'S ICY RINGS MAKE YOU LAND AT TITAN. TITANIONS AWAIT—PREPARE TO BATTLE. (FACT: THE SECOND LARGEST PLANET ORBITS THE SUN ONCE EVERY 29 EARTH YEARS.) Players take another Saturn card, place their shuttle on Titan (collect CC) and begin battle with the Aliens. (See Aliens And Battles section)

THIS IS YOUR LUCKY PLANET. YOU GAIN A GIFT FROM? (CHOOSE SHUTTLE) (FACT: SATURN HAS THE MOST RINGS AND AT LEAST 18 MOONS; TWO MOONS ARE CALLED SHEPHERDS AS THEY KEEP THE RINGS IN PLACE.) (See Planet Cards section).

URANUS

"THE POWERS" HAVE MIS-JUDGED THE PLANET'S ECCENTRIC TILT AND YOU LAND AT A DANGEROUS TIME. LEAVE AT ONCE. (FACT: THERE ARE RINGS ROUND URANUS AND AT LEAST 15 MOONS.) Players immediately leave the planet in Normal play.

THIS IS YOUR LUCKY PLANET. YOU GAIN A GIFT FROM? (CHOOSE SHUTTLE) (FACT: URANUS WAS THE FIRST PLANET TO BE DISCOVERED SINCE THE USE OF THE TELESCOPE.) (See Planet Cards section).

NEPTUNE

NEPTUNE'S SCOOTER* ZOOMS YOU STRAIGHT TO SATURN. (*FASTEST CLOUD.) (FACT: A METHANE GAS ATMOSPHERE GIVES NEPTUNE ITS DEEP BLUE COLOR.) Players place their shuttle on Saturn and take a Saturn Planet card.

SUPERSONIC WINDS FROM THE GREAT DARK SPOT FLY YOU TO URANUS. (FACT: NEPTUNE HAS THE FASTEST PLANET WINDS—UP TO 1200 MPH AT THE GREAT DARK SPOT (GIGANTIC STORM).) Players place their shuttle on Uranus and take a Uranus Planet card.

PLUTO

HAVING REACHED THE FURTHEST PLANET YOU MAY: TAKE ANOTHER CARD, COLLECT COSMIC CARBON AND LEAVE NOW VIA PLUTO EXPRESS. (FACT: PLUTO IS SMALLER THAN MOON TRITON.) Players take another Pluto card, gain one counter of Cosmic Carbon and immediately leave the planet via the Yellow Path.

THIS IS YOUR LUCKY PLANET. YOU GAIN A GIFT FROM? (CHOOSE SHUTTLE) (FACT: PLUTO IS THE SMALLEST PLANET IN THE SOLAR SYSTEM.) (See Planet Cards section).

Game Notes

All sizes of stars/Planets and whole layouts shown in the drawings are not drawn to scale, and spacing may change between star routes. Some Constellations are contained in the drawings (i.e. The Plough, Cassiopeia, Aries, Cepheus, Leo), others may be on a future layout, or none. Each quartile of the board is shown as having everything facing that players seating position (i.e. 4 quartiles where each aspects are directed North/South/East/West). Paths to Pluto and Spectroscope dice may be 4-sided or 6-sided depending on practicalities to manufacture. If 6-sided two colors will be repeated, or 6 paths used.

The drawings represent preferred embodiments of the game board. However, it should be understood that the invention is not restricted to just these two drawings. There are no set number of each star, planet or asteroids inside the Belt, but the 8 large asteroids will each one contain the letter: A,S,T,E,R,O,I,D. The arrow-directional lines leading from the Gateways of the large X to planets/places may be full or dotted lines. Whilst the majority of lines are drawn straight, some can be more rounded for effect, i.e., in Alien Alley, Star Cluster and Whirlpool Galaxy. All images, i.e., Black Holes, Star Locked Prism, Oscillating Ellipse, etc., may change in shapes with computer generated images. The Quick Glance Key card may contain more or less items from the text.

Keys: Where E=Escape and V=Velocity, EV=Event and H0=Horizon

Also CB=Crew Bank and LR=Lunar Repairs.

Even though the number of planets/moons is described, it should be understood that these numbers are not limited. In fact anything with a number to it, i.e., cards, Crew, Cosmic Carbon etc, should not be considered as being restricted to that actual number. Dice described and dice for 'The Powers That Be' or Spectroscope can be called dice or similar. For example, they may be replaced with a spinner or with a digital random number generator. New planets/Moons and places may be added without departing from the claimed invention, and names may be changed. Gateway numbers and their destination are not restricted. Card contents may vary in number/wording, still in keeping with the general idea. The large X spanning the whole of the board may be double lines (as in Plan 1) or single lines (as in Plan 2), or other designs. Some cards may contain appropriate symbols.

It is to be understood that the board will be approximately colored to provide an attractive appearance and also to facilitate playing of the game by identification and characterization of features appearing on the board. Analogously, the different types of cards utilized can be identified and distinguished from one another by color, design, shape, size or any other characteristics.

The features disclosed in the foregoing description, or the following claims, or the accompanying drawings, expressed in their specific forms or in terms of a means for performing the disclosed function, or a method or process for attaining the disclosed results, as appropriate, may, separately, or in any combination of such features, be utilized for realizing the invention in diverse forms thereof.

Although the preferred embodiment is described as a game board, it will be appreciated that the "game board" may be in the form where it is displayed on a video monitor, and that the various features of the game may be implemented with a programmed digital computer, or with a plurality of digital computers connected over a network. The computer may be programmed to provide random numbers similar to rolling dice, and to randomly select the various cards used to play the game.

It will be appreciated that various other modifications and changes may be made to the above described preferred embodiment of the board game without departing from the scope of the following claims.

What is claimed is:

1. A board game comprising:

a board having marked thereon a plurality of positions representing features in a real and/or imaginary region of space and with paths between selected ones of said positions;

a plurality of playing pieces for use by respective players of the game for movement along said paths in accordance with rules of the game;

means for generating a random code required for a player to win the game, said code consisting of a predetermined plurality of elements, at least some of which are different from one another;

a plurality of code element cards associated with each of a plurality of different ones of said positions on said board for collection by the players when their playing piece lands on said different ones of said positions, said code element cards for each position representing a different element some of which are elements of said plurality of elements, said elements on said code element cards being hidden from view by the players;

randomly operable indicating means for determining moves which may be made by said playing pieces; and randomly selectable indicating means associated with at least some of said positions on the board for determining. further factors associated with movement of said playing pieces.

2. A game according to claim 1, wherein the region of space represented on said board includes a solar system including at least some of the planets in our solar system, moons of one or more of said planets, and one or more fictional planets or other features.

3. A game according to claim 2, wherein each playing piece used by a player represents a space vessel.

4. A game according to claim 3 and further including pieces representing space vessel crew members, and wherein a player is required to equip his playing piece with appropriate crew members.

5. A game according to claim 1, and further including means representing a currency for use by players in transactions.

6. A game according to claim 1, and wherein the randomly operable indicating means includes at least one dice.

7. A game according to claim 1, and wherein the randomly selectable indicating means includes a plurality of cards to be selected by players.

8. A method of playing a game comprising the steps of:

a) providing a game board including representations of a plurality of space objects, and paths connecting selected ones of said space objects;

b) selecting a random code which is required to win said game;

c) assigning portions of said code to different space objects;

d) assigning a playing piece in the form of a space vessel to each player;

e) sequentially moving each player's space vessel along paths between said space objects in accordance random numbers selected by chance during each player's turn;

f) obtaining and following randomly selected instructions when a player's space vessel lands on selected ones of said space objects, and wherein a player may obtain a portion of said code by landing such player's space vessel on a space object containing a portion of said code; and g) after said code is obtained by a player, during the player's turn such player moves its space vessel along paths towards a predetermined destination, whereby the first player to obtain said code and reach said destination wins the game.

9. A method of playing a game, as set forth in claim 8, wherein an instruction may be to advance to said destination, and wherein said game is finished when a player reaches said destination.

10. A method of playing a game, as set forth in claim 9, wherein each player may obtain currency at selected ones of said space objects and from selected ones of said instructions, and wherein when the game is finished when a player reaching said destination in response to an instruction to advance to said destination, the winner is the player with the most currency.

11. A method of playing a game, as set forth in claim 10, and wherein each player acquires elements while playing the game, and wherein a player cannot move to said destination until obtaining a predetermined number and type of elements and said code.

12. A method of playing a game, as set forth in claim 10, and wherein each player acquires crew members while playing the game, and wherein a player cannot move to said destination until obtaining a predetermined number and type of crew members and said code.

13. A board game, as set forth in claim 10, and wherein portions of said code elements and portions of different elements are assigned to different space objects, and wherein the elements assigned to such different space objects are hidden from view by the players.

14. A board game comprising:

a playing board having marked thereon a plurality of positions including features in a region of space including planets and moons. and a plurality of paths between at least some of said features;

a plurality of play pieces used by respective players of the game for movement along said paths, said pieces representing space vessels;

randomly operable means for generating a code for each player, elements of said code being represented by different positions on said board and requiring visitation and collection of said code thereof by each player's playing piece;

random member indicating means for determining moves which may be made by said playing pieces;

cosmic currency elements for acquisition and trading transactions by said players;

a plurality of different crew member elements for said space vessels, said crew member elements being acquirable by said players using said cosmic currency and disposable by said players, said different crew member elements having markings thereon determining different possible actions and transactions by said players; and a plurality of randomly selectable elements of at least one variety, having markings thereon for instructing consequent actions by players acquiring them, said randomly selectable elements being associated with respective positions on said playing board.

15. A board game comprising:

a playing board having marked thereon a plurality of positions comprising features in a region of space including planets and moons, and a plurality of paths between at least some of said features;

a plurality of playing pieces used by respective players of the game for movement along said paths, said pieces representing space vessels;

randomly operable means for generating a code for each player, elements of said code being represented by different positions on said board and requiring visitation and collection of said code thereof by each player's playing piece;

random member indicating means for determining moves which may be made by said playing pieces;

cosmic currency elements for acquisition and trading transactions by said players;

crew member elements for said space vessels, said crew member elements being acquirable by said players using said currency and disposable by said players, said crew member elements having markings thereon determining different possible actions and transactions by said players; and a plurality of randomly selectable elements having markings thereon including instructions for consequent actions by players acquiring them, said randomly selectable elements including: fate/fortune cards, Sun cards, Jupiter cards, destiny cards, and green planet cards.

16. A board game according to claim 15 and further including at least some of dump tokens, dork attachments, comet rings, space mile token and valuable element cards.

17. A board game according to claim 16 and wherein said crew member elements have markings comprising at least some of celestial astronauts, navigators, planarians, scientists, benefactor, cometographer, futurist, member of the galaxy alienator, cloned service menial, green mouse, and mad scientist.

18. A board game according to claim 16 and wherein said marking of features on said playing board comprises at least some of alien alley, star cluster, whirlpool galaxy, mini black hole, massive black hole, oscillating eclipse, star locked prisms, worm hole zone, and asteroid belt.

* * * * *